US007053917B2

(12) United States Patent
Kato et al.

(10) Patent No.: US 7,053,917 B2
(45) Date of Patent: May 30, 2006

(54) DISPLAY DEVICE

(75) Inventors: Kazuhito Kato, Yokohama (JP); Satoshi Kitazaki, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 47 days.

(21) Appl. No.: 10/669,050

(22) Filed: Sep. 24, 2003

(65) Prior Publication Data

US 2004/0100419 A1 May 27, 2004

(30) Foreign Application Priority Data

Nov. 25, 2002 (JP) ..... 2002-340711
Feb. 21, 2003 (JP) ..... 2003-044052

(51) Int. Cl.
*G09G 5/00* (2006.01)

(52) U.S. Cl. ..... 345/672

(58) Field of Classification Search ..... 345/672–688
See application file for complete search history.

(56) References Cited

U.S. PATENT DOCUMENTS 5,691,471 A * 11/1997 Okazaki et al. ..... 73/504.04
6,317,114 B1 * 11/2001 Abali et al. ..... 345/672
2002/0027547 A1 * 3/2002 Kamijo et al. ..... 345/157
2002/0099257 A1 * 7/2002 Parker et al. ..... 600/27
2002/0101510 A1 * 8/2002 Basson et al. ..... 348/169
2002/0186348 A1 * 12/2002 Covannon et al. ..... 351/240
2003/0023192 A1 * 1/2003 Foxlin ..... 600/595
2004/0109093 A1 * 6/2004 Small-Stryker ..... 348/739
2004/0110565 A1 * 6/2004 Levesque ..... 463/42
2004/0239687 A1 * 12/2004 Idesawa et al. ..... 345/623

FOREIGN PATENT DOCUMENTS

JP 08-220470 A 8/1996
JP 10-073785 A 3/1998

* cited by examiner

*Primary Examiner*—Kee M. Tung
*Assistant Examiner*—Eric Woods
(74) *Attorney, Agent, or Firm*—Shinjyu Global IP Counselors

(57) ABSTRACT

A display device is provided that does not cause the viewer to experience a feeling that something is abnormal, even when the relative positions of the display device and the viewer fluctuate. The display device basically includes a display section, a motion detecting section, an image displacement computing section and a display control section. The display section displays an image within a display region of a non-head mounted display screen. The motion detecting section detects a movement of the display section. The image displacement computing section computes a translational displacement of the display section based on the movement of the display section. The display control section adjusts a display position of the image within the display region of the display section based at least on the translational displacement of the display section. As a result, the displayed image appears stationary in space to the viewer.

17 Claims, 11 Drawing Sheets

| | Display Position $X_{T-1}$ Immediately Before Calculation | Change In Screen Postion $\Delta X_H$ At $f \geq fc$ | Change In Screen Position $\Delta X_L$ At $f < fc$ | Average Displacement $X_M$ During Time Period T |
|---|---|---|---|---|
| Seady-State Travel | ○ | ○ | × | ○ |
| Acceleration or Deceleration | ○ | ○ | ○ | × |

DISPLAY DEVICE

CROSS-REFERENCE TO RELATED APPLICATION

This application claims priority to Japanese Patent Application Nos. 2002-340711 and 2003-44052. The entire disclosures of Japanese Patent Application Nos. 2002-340711 and 2003-44052 are hereby incorporated herein by reference.

BACKGROUND OF THE INVENTION

1. Field of the Invention

The present invention relates to a display device that can be installed in a vehicle for displaying images to a passenger inside the vehicle. The display device of the present invention can also be utilized as a portable-type display device.

2. Background Information

Regarding display devices that display images for a viewer, there are known technologies for preventing the viewer from experiencing a discomfort or incongruous feeling when the viewer moves with respect to a display section of the display device. This discomfort or incongruous feeling is often caused because the visual information the viewer obtains when watching an imaged displayed on the display section does not match the information from the vestibular organs (semicircular canals and otolith organs).

One example of a display device is disclosed in Japanese Laid-Open Patent Publication No. 10-73785 which discloses using a Fresnel lens or other optical element arranged between the display device and the viewer. The Fresnel lens causes the viewer to see a virtual image projected to a position close to infinity. When the viewer views from below a normal line of the Fresnel lens, the projected image is seen above the normal line. When the viewer views from above a normal line, the projected image is seen below the normal line.

Another example of a display device is disclosed in Japanese Laid-Open Patent Publication No. 8-220470 which discloses mounting the display device a viewer's head. This display device causes an image to appear stationary to the viewer wearing the display device by scrolling the displayed image oppositely to the movement of the viewer's head when the viewer's head moves.

In view of the above, it will be apparent to those skilled in the art from this disclosure that there exists a need for an improved display device that substantially prevents the viewer from experiencing a discomfort or incongruous feeling when the viewer moves with respect to a display section of the display device. This invention addresses this need in the art as well as other needs, which will become apparent to those skilled in the art from this disclosure.

SUMMARY OF THE INVENTION

It has been discovered that in the conventional display device disclosed in Japanese Laid-Open Patent Publication No. 10-73785, it is difficult to reduce the size of the display of the image in a case where the display device is installed inside a vehicle because an optical element is disposed between the viewer and the display device and it is necessary to secure space for the optical path of the optical element.

It has been discovered that in the conventional display device disclosed in Japanese Laid-Open Patent Publication No. 8-220470, the conventional display device is required to be fastened to the viewer's head. Thus, the conventional display device of this publication is not well-suited for those situations in which an image is viewed on a display device that is installed inside a vehicle or a display device that is held in the hand of the viewer.

An object of the present invention is to provide a display device that can be installed in a vehicle or utilized as a portable display device that do not cause the viewer to experience a discomfort or incongruous feeling when the relative positions of the display device and the viewer fluctuate.

The foregoing object of the present invention can basically be attained by providing a display device that basically comprises a display section, a motion detecting section, an image displacement computing section and a display control section. The display section is configured and arranged to display an image within a display region of a non-head mounted display screen. The motion detecting section is configured and arranged to detect a movement of the display section. The image displacement computing section is configured to compute a translational displacement of the display section based on the movement of the display section. The display control section is configured to adjust a display position of the image within the display region of the display section based at least on the translational displacement of the display section.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure:

FIG. 5(*b*) is a diagrammatic view illustrating a shifting of the image on the image display section executed in order to cancel the downward pitch motion of the vehicle when the vehicle nosedives in accordance with the first embodiment of the present invention;

FIG. 5(*c*) is a diagrammatic view illustrating displacement of the position of the image display section of the display device due to upward pitch motion of the vehicle when the vehicle squats in accordance with the first embodiment of the present invention;

FIG. 5(*d*) is a diagrammatic view illustrating a shifting of the image on the image display section executed in order to cancel the upward pitch motion of the vehicle when the vehicle squats in accordance with the first embodiment of the present invention;

FIG. 6(*b*) is a diagrammatic view illustrating a shifting of the image on the image display section executed in order to cancel the downward/forward pitch motion of the passenger's head (particularly the passenger's eyes) when the passenger's head pitches downward/forward in accordance with the first embodiment of the present invention;

FIG. 6(*c*) is a diagrammatic view illustrating displacement of the position of the display section due to upward/rearward pitch motion of a passenger's head (particularly passenger's eyes) in accordance with the first embodiment of the present invention;

FIG. 6(*d*) is a diagrammatic view illustrating a shifting of the image executed in order to cancel the upward!rearward pitch motion of the passenger's head or head portion (particularly the passenger's eyes) when the passenger's head pitches upward/rearward;

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. Not withstanding the above definition of "substantially", the term "substantially cancel" as used herein to describe the image shifting process refers to image shifting that appears to stabilize the image to the viewer to reduce a discomfort or incongruous feeling by the viewer due to fluctuations in the relative positions of the display device and the viewer.

Basically, the display devices of the present invention as described below are configured and arranged to detect a movement of the display device, compute a translational displacement of the image displayed based on the detected information, and execute an image shifting process that shifts the displayed image in order to cancel or substantially cancel the movement of the display device such that the viewer does not experience a discomfort or incongruous feeling when the relative positions of the display device and the viewer fluctuate.

First Embodiment

Figure 1:
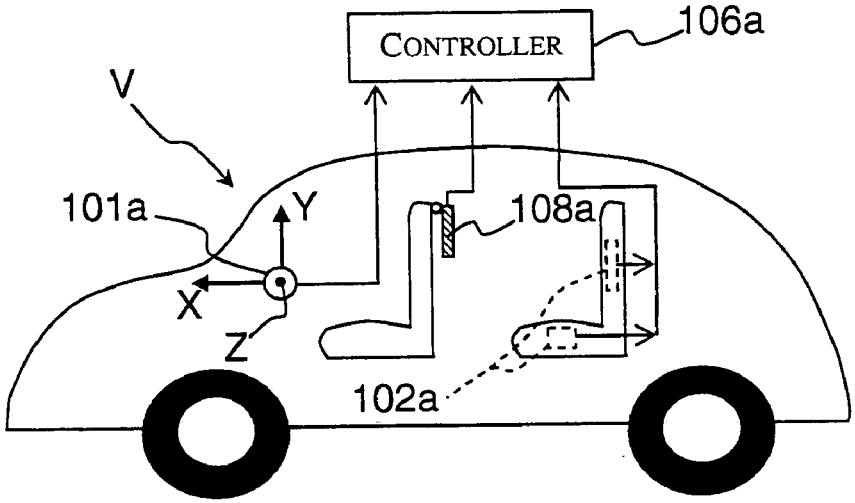
FIG. 1 is a schematic side view of a vehicle with a display device in accordance with a first embodiment of the present invention.
Figure 2:
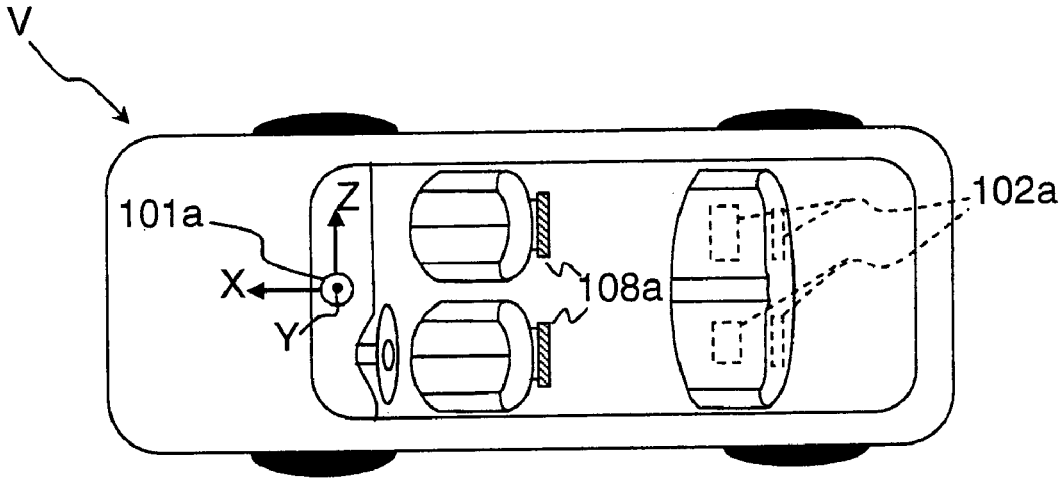
FIG. 2 is a schematic top plan view of the vehicle illustrated in FIG. 1 with the display device in accordance with the first embodiment of the present invention.
Figure 3:
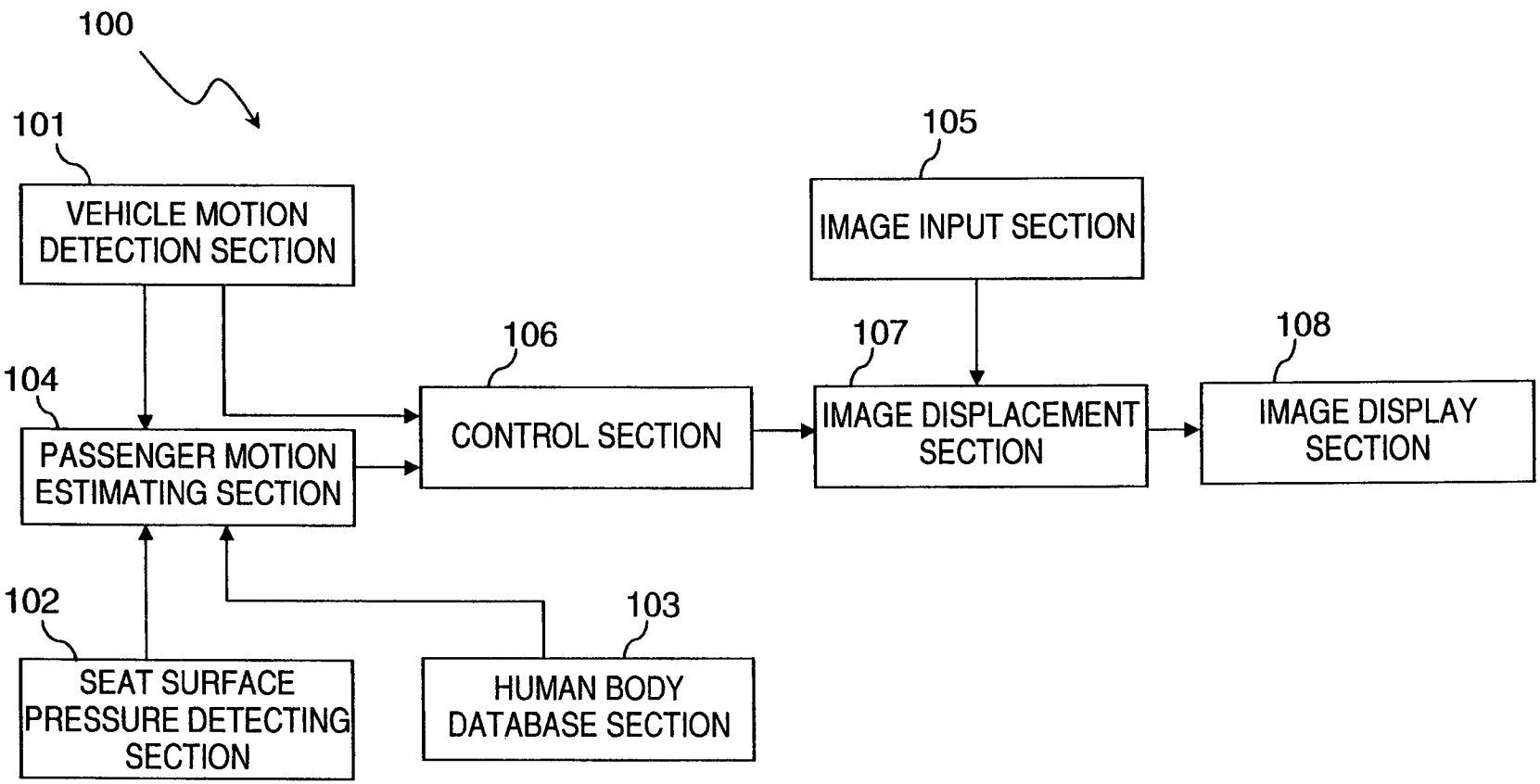
FIG. 3 is a block diagram of the display device adapted to be installed in the vehicle illustrated in FIG. 1 in accordance with the first embodiment of the present invention.

Referring initially to FIGS. 1 to 3, a vehicle V is illustrated that is equipped with a vehicle-installed display device 100 (FIG. 3) in accordance with a first embodiment of the present invention. FIG. 3 is a block diagram illustrating the display device 100 in accordance with the first embodiment of the present invention. The display device 100 of the first embodiment is adapted to be installed in the vehicle V for displaying an image to a passenger. The display device 100 in accordance with the present invention determines a motion value related to the head (eye) of a passenger by either actually detecting or estimating a movement of the head (eye) of the passenger, computes the translational displacement of a displayed image based on the detected vehicle movement, and displays the image based on information indicating the translational displacement and the motion value related to the head (eye) of the passenger in such a manner as to cancel the displacement of the displayed image and the relative displacement between the head (eye) of the passenger and the displayed image.

Referring primary to FIG. 3, the vehicle-installed display device 100 basically comprises a vehicle motion detecting section 101 with a sensor 101*a* (FIGS. 1 and 2), a passenger motion estimating section 104, a seat surface pressure detecting section 102 with a plurality of sensors 102*a* (FIGS. 1 and 2), a human body database section 103, a control section 106 with a controller 106*a* (FIGS. 1 and 2), an image input section 105, an image displacement section 107, and an image display section 108 with at least one display screen 108*a* (two shown in FIGS. 1 and 2). A viewer or a passenger sits on a rear seat inside the vehicle V (FIGS. 1 and 2) and views an image displayed on one of the display screens 108*a* of the image display section 108. The vehicle-installed display device 100 in accordance with the first embodiment of the present invention is configured to make the image displayed on the display screen 108*a* appear stationary in space to the passenger who is observing the image displayed in the display screen 108*a* even when there is a relative displacement between the display screen 108*a* and a passenger's head when the vehicle undulates.

More specifically, in the first embodiment, the relative displacement between a head portion (particularly the eyes) of the passenger and the display screen 108*a* is calculated based on a motion of the vehicle and a motion of the passenger's head. Then, the entire image (including text) within a display region of the display screen 108*a* is shifted relative to the housing of the display screen 108*a* in accordance with the relative displacement so that the image appears stationary in space to the passenger. Moreover, in the first embodiment of the present invention, the motion of the passenger's head or head portion (particularly the eyes) is estimated using body pressure distribution detected from a seat on which the passenger sits.

The vehicle motion detection section 101 is configured and arranged to detect both a translational (linear) motion and a rotational (angular) motion of the vehicle and output signals indicating the detected motions of the vehicle to the passenger motion estimating section 104 and the control section 106. The seat surface pressure detecting section 102 is configured and arranged to detect the body pressure distribution on the seat on which the viewer (in this case, the passenger of the vehicle) is sitting and output signals indicating the body pressure distribution on the seat to the passenger motion estimating section 104. The human body database section 103 is configured and arranged to store data indicating the relationship between the body pressure distribution on the seat and a physique of the passenger and data indicating the relationship between the body pressure distribution on the seat and a sitting posture of the passenger. Also, the human body database section 103 is configured and arranged to store data indicating vibration transmission functions or response functions of vibrations of human bodies for various parts of the human body (particularly the head) in relation to vehicle undulations or movements. The data stored in the human body database section 103 is obtained in advance from measurements of a plurality of test subjects having different physiques and stored in a database form. The vehicle undulations or movements are indicated by the vehicle motion values detected by the vehicle motion detection section 101.

Accordingly, the human body database section 103 of the first embodiment is configured to store data that indicates vibration transmission functions that serve as information regarding how the various body parts (particularly the head or portion thereof) vibrate or move in response to vehicle undulations. It will be apparent to those skilled in the art from this disclosure that the human body database section 103 can be configured to store a numerical model in table form. More specifically, a LUT (look up table) can be constructed such that when a value indicating the undulations of the vehicle is inputted to the LUT stored in the human body database section 103, a numerical value indicating the vibrations of the human body in response to those undulations is outputted based on the LUT.

The passenger motion estimating section 104 is configured and arranged to estimate a motion (displacement) of the passenger's head or head portion, particularly the passenger's eyes, by reading information indicating the head motion of a person having a physique and posture similar to those of the passenger from the human body database section 103 based on the detection value indicating the body pressure distribution and the detection value indicating the vehicle motion. The passenger motion estimating section 104 is further configured and arranged to send information indicating the estimated displacement of the passenger's head or head portion, especially the passenger's eyes, to the control section 106.

The image input section 105 is configured and arranged to receive display data from an external device (e.g., video tape player, DVD player, etc.) and send the display data to the image displacement section 107. The display data is data for an image or text to be displayed within the display region of the display screen 108*a*.

The control section 106 is configured to determine the amount of displacement of the image with respect to the display region of the display screen 108*a* using the information indicating the estimated displacement of the passenger's eyes and the detection signal indicating the vehicle movements. Moreover, the control section 106 is configured to send information indicating the amount of image displacement with respect to the display region of the display screen 108*a* determined by the control section 106 to the image displacement section 107.

The control section 106 preferably includes a microcomputer with a control program that controls the vehicle-installed display device 100 as discussed below. The control section 106 can also include other conventional components such as an input interface circuit, an output interface circuit, and storage devices such as a ROM (Read Only Memory) device and a RAM (Random Access Memory) device. The microcomputer of the control section 106 is programmed to control the vehicle-installed display device 100. The memory circuit stores processing results and control programs such as ones for image displaying operation that are run by the processor circuit. The control section 106 is operatively coupled to the other sections of the vehicle-installed display device 100 in a conventional manner. Thus, in addition to determining the amount of image displacement, the control section 106 is configured to control the other sections of the vehicle-installed display device 100. The internal RAM of the control section 106 stores statuses of operational flags and various control data. The control section 106 is capable of selectively controlling any of the components of the control system of the vehicle-installed display device 100 in accordance with the control program. It will be apparent to those skilled in the art from this disclosure that the precise structure and algorithms for the control section 106 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

Based on the information indicating the amount of image displacement determined by the control section 106, the image displacement section 107 is configured to modify the display data in such a manner that the position of the image, including text, moves (shifts) within the display region of the display screen 108*a*. The operation of shifting of the image is discussed below in more detail.

After the display data is modified, the image displacement section 107 is configured to send the modified display data to the image display section 108 as a display signal adapted to the input interface of the image display section 108. For example, the display screen 108*a* is a liquid crystal display device that is configured and arranged to display images (including text) in accordance with the inputted display signal. Of course, it will be apparent to those skilled in the art that other display devices can be used to carry out the present invention.

Figure 4:
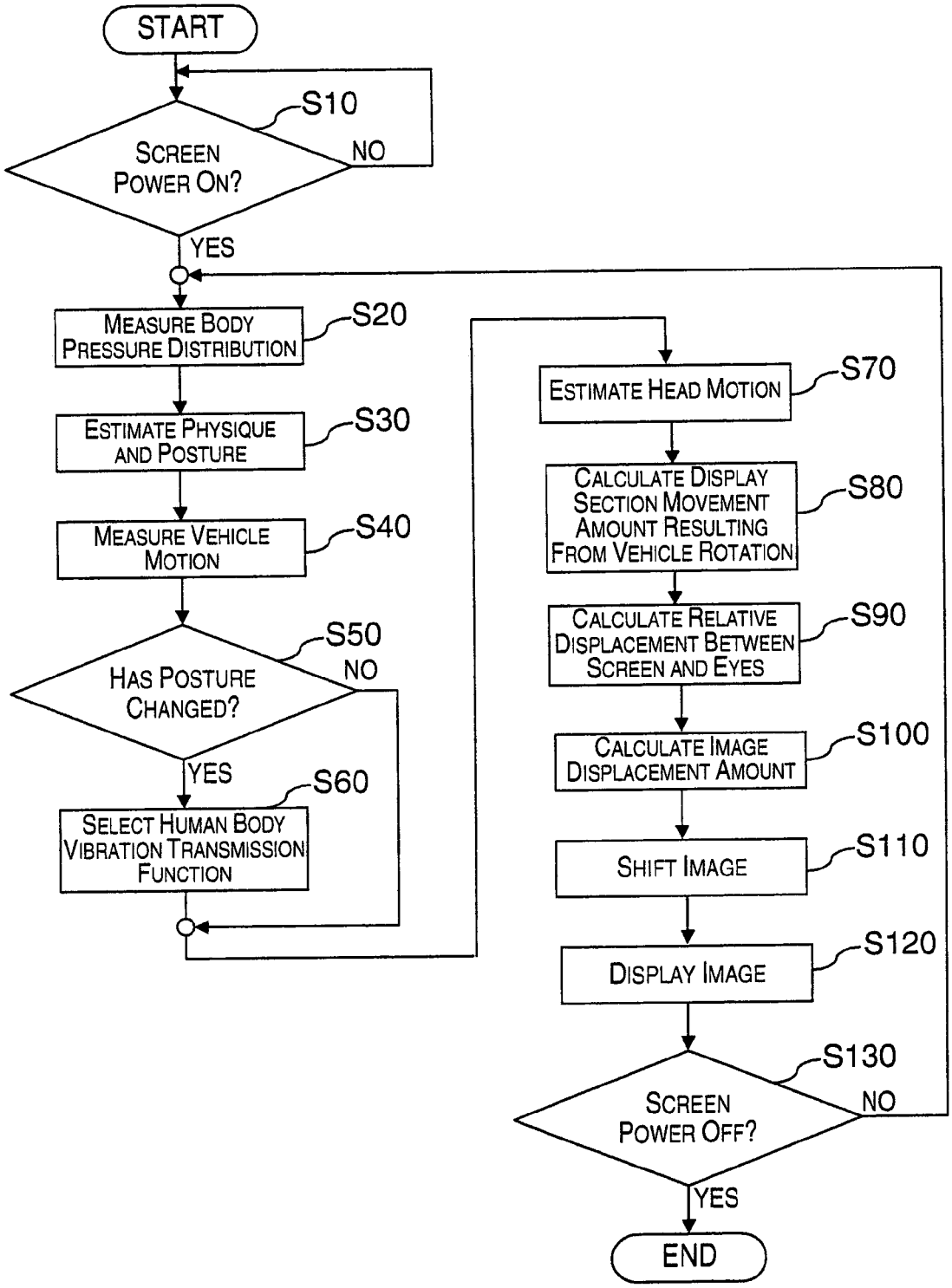
FIG. 4 is a flowchart illustrating a flow of the display processing executed by a control section of the display device in accordance with the first embodiment of the present invention.
Figure 5A:
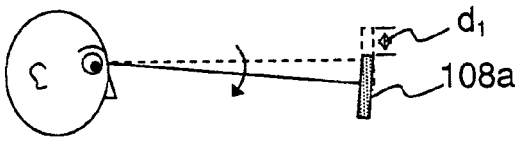
FIG. 5(*a*) is a diagrammatic view illustrating displacement of a position of a image display section of the display device due to downward pitch motion of the vehicle when the vehicle nosedives in accordance with the first embodiment of the present invention.
Figure 5B:
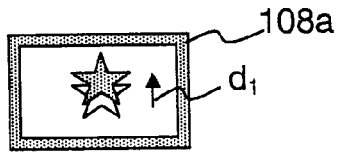
Figure 5C:
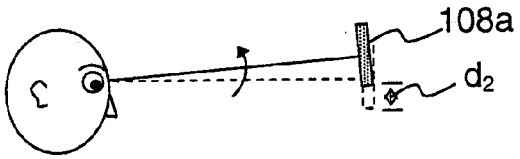
Figure 5D:
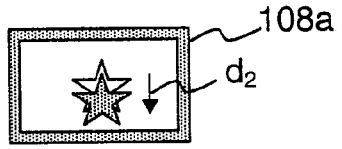
Figure 6A:
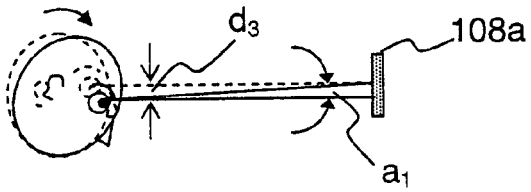
FIG. 6(*a*) is a diagrammatic view illustrating displacement of the position of the image display section due to downward/forward pitch motion of a passenger's head (particularly passenger's eyes) in accordance with the first embodiment of the present invention.
Figure 6B:
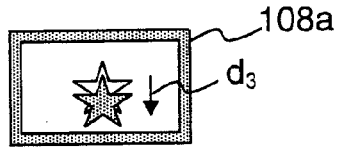
Figure 6C:
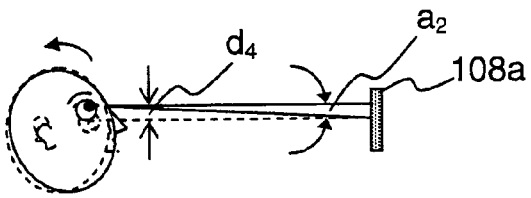
Figure 6D:
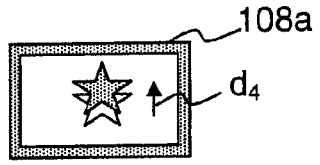

Referring now to a flow chart shown in FIG. 4, the flow of the display processing executed by the control section 106 of the vehicle-installed display device 100 will now be described. In step S10, the control section 106 is configured to determine if the power to the display screen 108*a* is ON. If the power is ON, the control section 106 is configured to obtain an affirmative result for step S10 and proceed to step S20. If the power is not ON, the control section obtains a negative result for step S10 and repeat step S10.

In step S20, the control section 106 is configured to issue a command to the seat surface pressure detecting section 102 instructing to detect the body pressure distribution on the seat on which the passenger is sitting (body pressure measurement) and then proceed to step S30. In step S30, the control section 106 is configured to issue a command to the passenger motion estimating section 104 instructing to estimate the physique and sitting posture of the passenger and then proceed to step S40. In response to the command issued in step S30, the passenger motion estimating section 104 is configured to search the human body database stored in the human body database section 103 and select a physique and sitting posture corresponding to a body pressure distribution that is closest to the detected body pressure distribution as the estimate values for the physique and posture of the passenger.

In step S40, the control section 106 is configured to issue a command to the vehicle motion detecting section 101 instructing to detect the motion of the vehicle (motion measurement) and then proceed to step S50. In response to the command issued in step S50, the vehicle motion detecting section 101 is configured to detect translational and rotational motions of the vehicle. In step S50, the control section 106 is configured to determine if the passenger's sitting posture has changed. The control section 106 is configured to compare a previous estimate value for the physique and sitting posture of the passenger to a current estimate value for the physique and sitting posture of the passenger. If the two estimate values are different, the control unit 106 is configured to obtain affirmative result for step S50 and proceed to step S60. If the two estimate values are the same, the control unit 106 is configured to obtain negative result for step S50 and proceed to step S70 and uses a previously determined human body vibration function from the prior program cycle.

In step S60, the control section 106 is configured to issue a command to the passenger motion estimating section 104 instructing to select a human body vibration transmission function and then proceed to step S70. In response to the command issued in step S60, the passenger motion estimating section 104 is configured to search the human body database stored in the human body database section 103 and select a human body vibration transmission function corresponding to the current estimate value for physique and sitting posture of the passenger and the latest detection value for the vehicle motion.

In step S70, the control section 106 is configured to issue a command to the passenger motion estimating section 104 instructing to estimate the motion of the passenger's head and then proceed to step S80. In response to the command issued in step S70, the passenger motion estimating section 104 is configured to calculate an estimate value for the motion of the passenger's head or head portion (particularly the eyes) using the human body vibration transmission function and the detection value of the vehicle motion.

When there is plenty of distance between the display screen 108*a* and the passenger, the processing of step S70 can be skipped because the motion (displacement) of the passenger's eyes due to rotation of the passenger's head with respect to the display screen 108*a* is small. In such a case, it is sufficient to find the relative displacement between the passenger's eyes and the display screen 108*a* under the assumption that position of the passenger's eyes is fixed.

In step S80, the control section 106 is configured to use the detection value of the vehicle motion to calculate the amount of translational displacement of the display screen 108*a* associated with the vehicle motion and then proceed to step S90. In the first embodiment of the present invention, an upward or downward rotational motion of the vehicle in a pitch direction (up or down) due especially to acceleration or deceleration of the vehicle is used as an example of the vehicle motion. Thus, the translational displacement of the image displacement section 108 calculated here is an amount by which the display screen 108*a* moves in the pitch direction (up or down) in response to the upward or downward rotational motion of the vehicle. Of course, it will be apparent to those skilled in the art from this disclosure that similar processing can be performed in step S80 with respect to rotational motion of the vehicle in the rolling direction (left and right) of the vehicle. In such a case, the translational displacement of the image displacement section 108 will be an amount by which the display screen 108*a* moves in the rolling direction (left and right) in response to the rotational motion of the vehicle in the rolling direction. Moreover, it will be apparent from this disclosure the vehicle motion that is detected also includes any kind of vehicle undulation such as a vibration caused by a rough road surface.

In step S90, the control section 106 is configured to calculate the relative displacement between the eyes of the passenger and the display screen 108*a* and then proceed to step S100. In step S100, the control section 106 is configured to calculate the amount by which the image displayed by the image display section 108 needs to be shifted in order to appear stationary in space (without undulations) to the passenger based on at least the vertical displacement amount of the display screen 108*a* and the aforementioned relative displacement. Of course, it will be apparent to those skilled in the art from this disclosure that the control section 106 is alternatively configured to calculate the amount by which the image displayed by the image display section 108 needs to be shifted in order to appear stationary in space (without undulations) to the passenger based on both the vertical displacement amount and the horizontal displacement amount of the display screen 108*a* and the aforementioned relative displacement. Then, the control section 106 is configured to proceed to step S110.

In step S110, the control section 106 is configured to send information indicating the calculated amount of image displacement to the image displacement section 107 and issue a command instructing the image displacement section 107 to shift the image displayed in the display screen 108*a*. In response to the command issued in step S110, the image displacement section 107 is configured to modify the display data received through the image input section 105 in accordance with the displacement amount. Then, the control section 106 is configured to proceed to step S120.

In step S120, the control section 106 is configured to issue a command to the image display section 108 instructing to display the image using the modified display data and then proceed to step S130. As a result, an image that has been shifted within the display region of the display screen 108*a* is displayed on the display screen 108*a*.

In step S130, the control section 106 is configured to determine if the power to the display screen 108*a* has been turned OFF. If the power has been turned OFF, the control section 106 is configured to obtain an affirmative result for step S130 and end the processing of the flow chart shown in FIG. 4. If the power has not been turned OFF, the control section 106 is configured to obtain a negative result for step S130 and return to step S20 to repeat the processing.

Referring now to FIGS. 5(*a*)–6(*d*), the image shifting will now be described in more detail with respect to the relative vertical displacement between the passenger's head and the display screen 108*a*. Thus, focusing on motion in the pitch direction due to acceleration or deceleration of the vehicle, the displacement of relative positions of the passenger's eyes and the display screen 108*a* can be roughly divided into the following two types of displacement. The first type of displacement is vehicle displacement caused by a pitch motion of the vehicle. The second type of displacement is passenger displacement caused by a pitch motion of the passenger (particularly the passenger's eyes).

Of course, it will be apparent to those skilled in the art from this disclosure that the image shifting is alternatively also calculated in the same manner with respect to the relative horizontal displacement between the passenger's head and the display screen 108*a*.

Referring now to FIGS. 5(*a*)–5(*b*), the relative displacement between the ground surface and the vehicle (displacement of the image display section 108 caused by pitch motion of the vehicle) will now be described with reference to FIG. 5(*a*)–5(*d*). Generally, when a vehicle decelerates, a nosedive phenomenon occurs in which the front section of the vehicle dips downward. If the display screen 108*a* of the image display section 108 is located in the forward direction of vehicle movement with respect to the passenger, the nosedive will cause the display screen 108*a* to undergo rotational motion in the downward pitch direction as seen in FIG. 5(*a*). Consequently, assuming the position of the passenger's head or head portion (particularly the passenger's eyes) does not move, the display screen 108*a* will appear to the passenger to move downward by an amount $d_1$. Therefore, the control section 106 is configured to modify the display data in order to shift the display position of the image within the display region of the display screen 108*a* in the upward pitch direction by the amount $d_1$ as seen in FIG. 5(*b*).

More specifically, FIG. 5(*b*) illustrates the image shifting process executed in order to cancel or substantially cancel the downward pitch motion of the display screen 108*a* when the vehicle nosedives. As shown in FIG. 5(*b*), the image displayed on the display screen 108*a* is moved upward in accordance with the amount $d_1$ by which the display screen 108*a* moves downward. As a result, the relative displacement between the image displayed in the display screen 108*a* and the eyes of the passenger is zero and the image displayed in the image display section appears stationary in space to the passenger. In other words, the upward shifting of the image within the display region of the display screen 108*a* cancels out or substantially cancels out the downward movement of the display screen 108*a*. Therefore, the image displayed in the image display section appears stationary in space to the passenger.

Conversely to when the vehicle decelerates, when the vehicle accelerates, a squatting phenomenon occurs in which the rear section of the vehicle dips downward. If the display screen 108*a* of the image display section 108 is located in the forward direction of vehicle movement with respect to the passenger, the squatting will cause the display screen 108*a* to undergo rotational motion in the upward pitch direction as seen in FIG. 5(*c*). Consequently, assuming the position of the passenger's head or head portion (particularly the passenger's eyes) does not move, the display screen 108*a* will appear to the passenger to move upward by an amount $d_2$. Therefore, the control section 106 is configured to modify the display data in order to shift the display position of the image in the downward pitch direction by the amount $d_2$ as seen in FIG. 5(*d*).

More specifically, FIG. 5(*d*) illustrates the image shifting executed in order to cancel the upward pitch motion of the display screen 108*a* when the vehicle squats. As shown in FIG. 5(*d*), the image displayed on the display screen 108*a* is moved upward in accordance with the amount $d_2$ by which the display screen 108*a* moves downward. As a result, the relative displacement between the image displayed on the display screen 108*a* and the eyes of the passenger is zero. In other words, the downward shifting of the image in the display region of the display screen 108*a* cancels out the upward movement of the display screen 108*a*. Therefore, the image displayed on the display screen 108*a* appears stationary in space to the passenger.

Referring now to FIGS. 6(*a*)–6(*d*), the relative displacement between vehicle and passenger (change in eye height due to pitch motion of the passenger's head or head portion, particularly the passenger's eyes) will now be described. When the vehicle actually decelerates or accelerates, the passenger's head also undergoes rotational motion in the pitch direction. When the vehicle decelerates, the passenger's head rotates forward as shown in FIG. 6(*a*). Assuming the position of the display screen 108*a* does not move, the position of the passenger's head or head portion (particularly the passenger's eyes) moves downward with respect to the display screen 108*a*. This rotational movement changes the passenger's line of sight from a first level position to a second level position by an upward angle of $a_1$ as shown in FIG. 6(*a*). In other words, the level of the eyes of the passenger changes downward by an amount $d_3$. Therefore, in order to display the image on the display screen 108*a* such that it appears stationary in space to the passenger, the image displayed on the display screen 108*a* is shifted downward in accordance with the amount $d_3$ of downward movement of the passenger's eyes, as shown in FIG. 6(*b*). In other words, the direction of the image shift is the same as in FIG. 5(*c*), i.e., the same as when canceling the upward pitch motion of the display screen 108*a* associated with squatting of the vehicle.

Conversely to when the vehicle decelerates, when the vehicle accelerates, the passenger's head rotates rearward as shown in FIG. 6(*c*). Assuming the position of the display screen 108*a* does not move, the position of the passenger's head or head portion (particularly the passenger's eyes) moves upward with respect to the display screen 108*a*. This rotational movement changes the passenger's line of sight from a first level position to a second level position by a downward angle of $a_2$ as shown in FIG. 6(*c*). In other words, the level of the passenger's eyes changes upward by an amount $d_4$. Therefore, in order to display the image such that it appears stationary in space to the passenger, the image displayed on the display screen 108*a* is shifted upward in accordance with the amount $d_4$ of upward movement of the passenger's eyes as seen in FIG. 6(*d*). In other words, the direction of the image shift is the same as in FIG. 5(*b*), i.e., the same as when canceling the downward pitch motion of the display screen 108*a* associated with nosediving of the vehicle.

Accordingly, in the vehicle-installed display device 100 in accordance with the first embodiment of the present invention the relative displacement between the display screen 108*a* and the eyes of the passenger is calculated. When the vehicle is accelerating or decelerating, the relative displacement is caused by two types of pitch motion: the displacement caused by pitch motion of the vehicle; and the displacement caused by pitch motion of the passenger's head or head portion (particularly the passenger's eyes). The image shifting is performed based on the relative displacement in which the image is shifted within the display region of the display screen 108*a* in such a manner as to cancel the influences of the relative displacement.

Moreover, in the vehicle-installed display device 100 of the first embodiment, the displacement caused by the pitch motion of the passenger's head or head portion is determined by estimating the motion of the passenger's head in response to the vehicle motion. More specifically, the physique and sitting posture of the passenger is estimated by measuring the body pressure distribution on the seat that is exerted by the body of the passenger when seated and searching the human body database stored in the human body database section 103. As a result, an appropriate human body vibration transmission function can be selected regardless of whether the passenger is an adult or a child or a man or a woman.

Furthermore, since the human body vibration transmission function and the detection data indicating the vehicle motion are used to calculate an estimate value for the motion of the passenger's head or head portion (particularly the eyes), the position of the passenger's eyes can be estimated without providing motion detection sensors on the passenger's head. Thus, since the motion detecting sensors are not attached to the passenger, the cost is held in check and a burden is not placed on the passenger.

Since the amount by which the display screen 108*a* moves in the up or down pitch direction due to the upward or downward rotational motion of the vehicle is calculated using detection data that indicates the vehicle motion, the position of the display screen 108*a* can be obtained without providing a motion detection sensor for the display screen 108*a*.

Also, the relative displacement between the eyes of the passenger and the display screen 108*a* is found using the eye position estimated as mentioned above and the position of the display screen 108*a* obtained as mentioned above. Therefore, the relative displacement can be obtained even if the eyes of the passenger and the display screen 108*a* are undergoing different motions.

Accordingly, the image displayed on the display screen 108*a* appears stationary in space to the passenger because the display position of the image displayed on the display screen 108*a* is shifted in the up or down pitch direction in such a manner as to cancel the movement of the image on the display screen 108*a* resulting from movement in the up or down pitch direction of the display screen 108*a* based on the relative displacement between the passenger's eyes and the display screen 108*a*. As a result, the image is easier for the passenger to view. Moreover, since the visual information the passenger obtains when watching the display screen matches the information from the vestibular organs (semicircular canals and otolith organs), the uncomfortable or incongruous feeling of the passenger is reduced in comparison with a case in which the image is not shifted.

Second Embodiment

Figure 7:
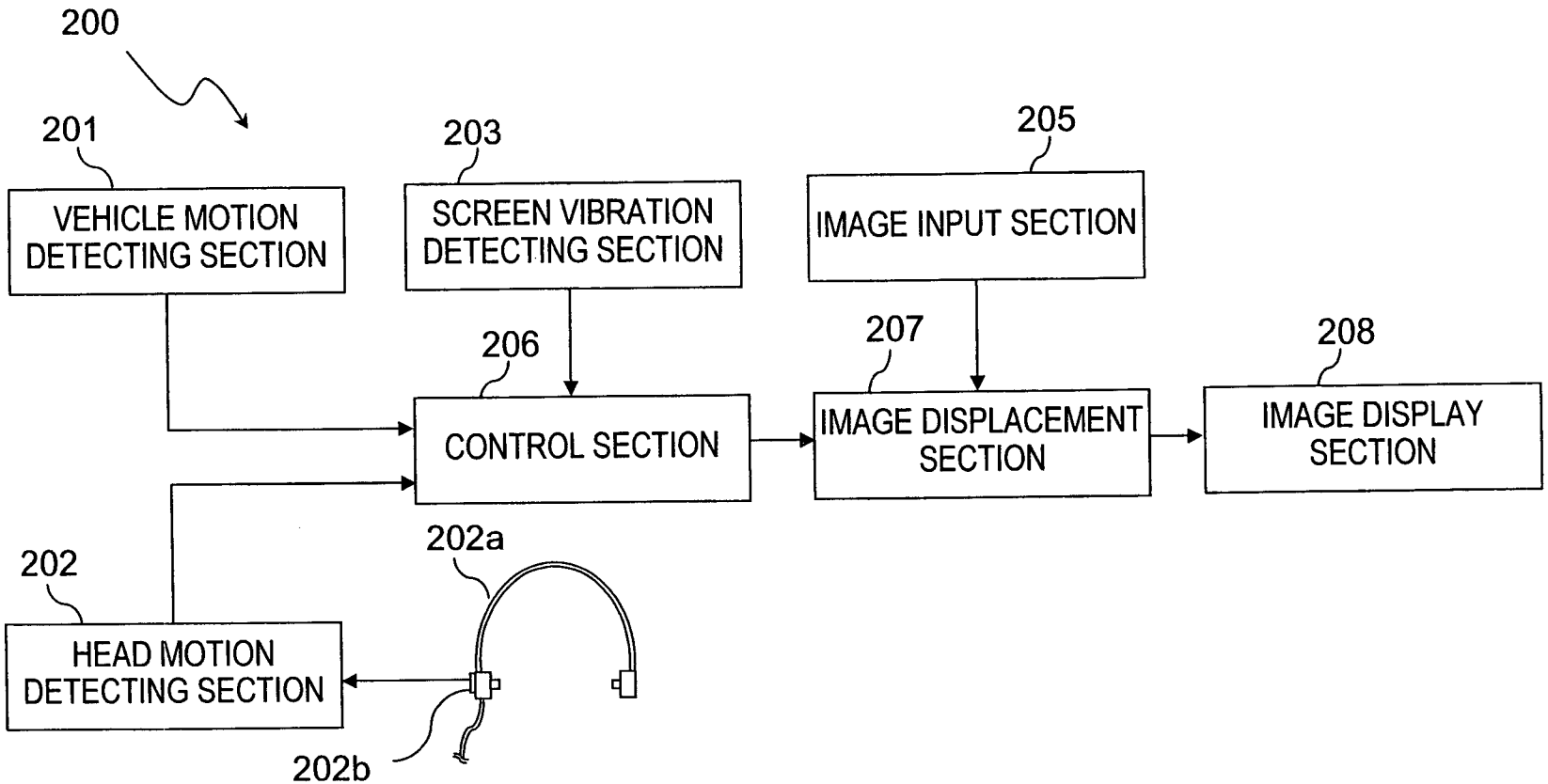
FIG. 7 is a block diagram illustrating a display device adapted to be installed in a vehicle in accordance with a second embodiment of the present invention.
Figure 8:
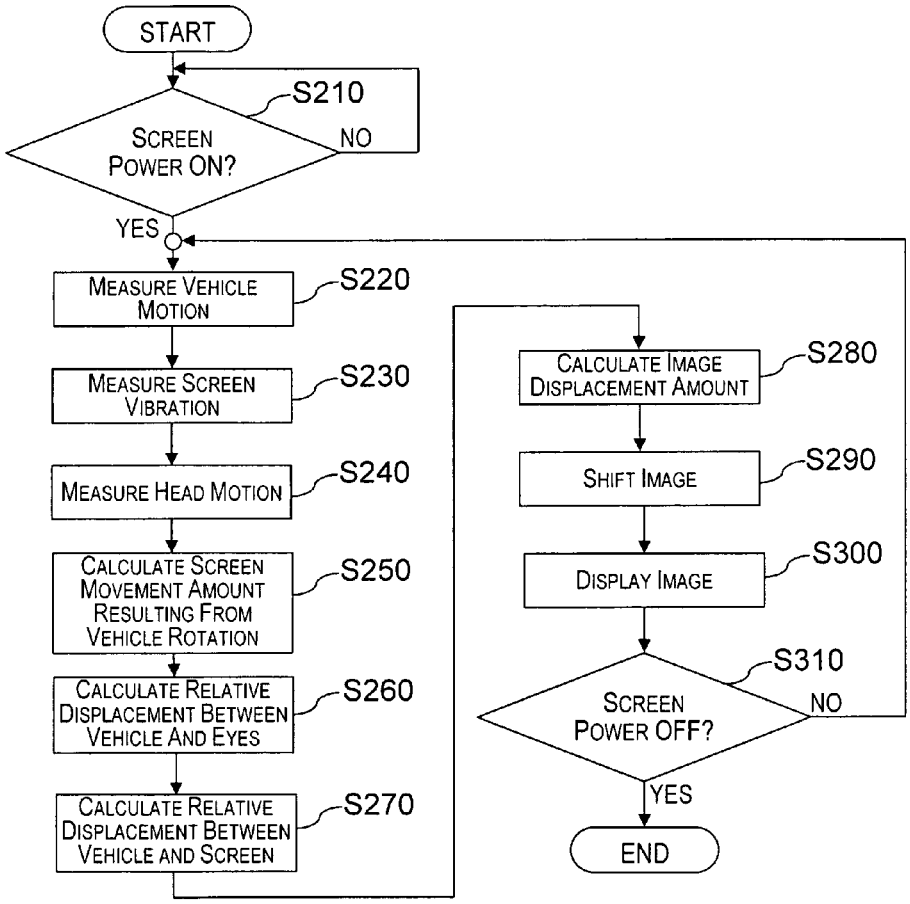
FIG. 8 is a flowchart illustrating a flow of the display processing executed by a control section of the display device in accordance with the second embodiment of the present invention.

Referring now to FIGS. 7 and 8, a vehicle-installed display device 200 in accordance with a second embodiment will now be explained. In view of the similarity between the first and second embodiments, the descriptions of the parts of the second embodiment that are identical to the parts of the first embodiment may be omitted for the sake of brevity.

FIG. 7 is a block diagram illustrating the vehicle-installed display device 200 in accordance with a second embodiment of the present invention. In the second embodiment of the present invention, the display device 200 is adapted to be installed in the vehicle V of FIGS. 1 and 2 for displaying an image to a passenger inside the vehicle. The vehicle-installed display device 200 of the second embodiment of the present invention computes the translational displacement of an image displayed by the display device 200, computes the relative displacement between the head of a viewer (passenger) and the displayed image, and makes the display device 200 display the image in such a manner as to cancel the computed displacement (relative displacement). Thus, the vehicle-installed display device 200 of the second embodiment of the present invention makes it possible to prevent a passenger viewing a displayed image from experiencing an uncomfortable or incongruous feeling when the relative positions of the display device and the head of the viewer fluctuate.

As seen in FIG. 7, the vehicle-installed display device 200 basically comprises a vehicle motion detecting section 201, a head motion detecting section 202 equipped with a head phones 202*a*, a screen vibration detecting section 203, a control section 206, an image input section 205, an image displacement section 207, and an image display section 208 with a display screen (e.g., such the vehicle mounted display screen 108*a* of FIGS. 1 and 2). The passenger or viewer views an image displayed on the image display section 208 inside the vehicle.

In the vehicle-installed display device 200 in accordance with the second embodiment of the present invention, the motion of the passenger's head or head portion (particularly the eyes) is detected directly by the head motion detecting section 202. Moreover, the motion of the image display section 208 is detected directly by the screen vibration detecting section 203. Thus, in this embodiment, the sections 201 and 203 individually as well as together act as motion detecting sections configured and arranged to defect movement of the screen of the image display section.

The vehicle motion detecting section 201 is configured to detect both the translational motion and the rotational motion of the vehicle and send a detection signal to the control section 206. The head motion detecting section 202 preferably comprises, for example, an acceleration sensor 202*b* built into the headphone 202*a* utilized by the viewer. The head motion detecting section 202 is configured to detect both the translational motion and the rotational motion of the viewer's head (the head of the passenger in the vehicle) and send the resulting detection signal to the control section 206.

In the second embodiment of the present invention, the head motion detecting section 202 is preferably configured and arranged to have a built-in acceleration sensor to detect the motion of the viewer's head. It will be apparent to those skilled in the art from this disclosure that the head motion detecting section 202 can also be configured and arranged to use a built-in gyro sensor or a magnetic position sensor instead of the acceleration sensor 202*b*. Moreover, the head motion detecting section 202 can also be configured and arranged to detect the motion of the viewer's head (particularly the eyes) by photographing the passenger using a vehicle-installed camera and analyzing the photographic image to obtain the motion (displacement) of the passenger's eyes. Any of the sensors mentioned above, i.e., an acceleration sensor, a gyro sensor, or a magnetic position sensor, can also be used in the vehicle motion detecting section 201 and/or the screen vibration detection section 203.

The screen vibration detecting section 203 is configured to detect the translational motion and the rotational motion of the image display section 208 and send the resulting detection signal to the control section 206. The image input section 205 is configured to receive display data from an external device (e.g., video tape player, DVD player, etc.) and send the display data to the image displacement section 207. The control section 206 is configured to determine the amount of relative displacement of the image with respect to the passenger's eyes based on the detection signal indicating the vehicle motion, the detection signal indicating the head motion, and the detection signal indicating the motion of the image display section 208. In addition to determining the amount of image displacement, the control section 206 is configured to control the other sections of the vehicle-installed display device 200. The control section 206 is configured to send information indicating the amount of image displacement determined by the control section 206 to the image displacement section 207. Based on the information indicating the amount of image displacement, the image displacement section 207 is configured to modify the display data in such a manner that the position of the image is shifted within a display region of the image display section 208. The image shifting is executed in the same manner as in the first embodiment.

After the display data is modified, the image displacement section 207 is configured to send the modified display data to the image display section 208 as a display signal. The image display section 208 is, for example, a liquid crystal display device. The image display section 208 is configured and arranged to display an image in accordance with the inputted display signal. In the second embodiment of the present invention, the image display section 208 is preferably fixedly coupled to an interior portion of the vehicle, such as a backrest, a ceiling portion or the like, so that the passenger can view the image displayed on the image display section 208. Of course, it will be apparent to those skilled in the art from this disclosure that the image display section 208 can be configured and arranged as a hand held unit to be held in the hand of the passenger instead of being fixedly mounted to the backrest or other portion of the vehicle as shown. The hand held unit would be electrically coupled to the control section 206, which is mounted in the vehicle, in a conventional manner such as an electrical cord or wireless communication devices.

Referring now to FIG. 8, the flow of the display processing executed by the control section 206 of the vehicle-installed display device 200 will be described. In step S210, the control section 206 is configured to determine if the power to the image display section 208 is ON. If the power is ON, the control section 206 is configured to obtain an affirmative result for step S210 and proceed to step S220. If the power is not ON, the control section 206 is configured to obtain a negative result for step S210 and repeat step S210.

In step S220, the control section 206 is configured to issue a command to the vehicle motion detecting section 201 instructing to detect the motion of the vehicle (motion measurement in the same manner as the first embodiment) and then proceed to step S230. In response to the command issued in step S220, the vehicle motion detecting section S201 is configured to detect the translational motion and rotational motion of the vehicle. In step S230, the control section 206 is configured to issue a command to the screen vibration detecting section 203 instructing to detect the motion of the image display section 208 and then proceed to step S240. In response to the command issued in step S230, the screen vibration detecting section S203 is configured to detect the translational motion and rotational motion of the image display section 208.

In step S240, the control section 206 is configured to issue a command to the head motion detecting section 202 instructing to detect the motion of the passenger's head and then proceed to step S250. In response to the command issued in step S240, the head motion detecting section 202 is configured to detect the translational motion and rotational motion of the passenger's head or head portion (particularly the passenger's eyes).

In step S250, the control section 206 is configured to use the detection signal indicating the vehicle motion detected by the vehicle motion detecting section 201 to calculate the amount of translational motion of the image display section 208 resulting from rotational motion of the vehicle and then proceed to step S260. This screen movement amount is the amount of movement of the image display section 208 in both the pitch direction (up and down) and the roll direction (left and right).

In step S260, the control section 206 is configured to calculate the relative displacement between the vehicle and the eyes of the passenger using the aforementioned detection values and then proceed to step S270. In step S270, the control section 206 is configured to calculate the relative displacement between the vehicle and the image display section 208 using the aforementioned detection values and proceed to step S280. In step S280, the control section 206 is configured to use the screen movement amount and the relative displacements just mentioned to calculate the displayed image displacement amount required to make the image displayed on the image display section 208 appear stationary in space (without undulations) to the passenger. A separate image displacement amount is calculated for each of the up-and-down direction and the left-and-right direction. Then the control section 206 is configured to proceed to step S290.

In step S290, the control section 206 is configured to send information indicating the calculated displacement amounts to the image displacement section 207 and issues a command instructing to shift the image up or down and/or left or right. In response to the command issued in step S290, the image displacement section 207 is configured to modify the display data received from the image input section 205 in accordance with the displacement amounts. The control section 206 is configured to proceed to step S300.

In step S300, the control section 206 is configured to issue a command to the image display section 208 instructing to display the image described by the modified display data and then proceed to step S310. In response to the command issued in step S300, the image display section 208 is configured to display an image that has been shifted within the display region of the image display section 208. In step S310, the control section 206 is configured to determine if the power to the image display section 208 is OFF. If the power is OFF, the control section 206 is configured to obtain an affirmative result for step S310 and end the processing of the flow chart shown in FIG. 8. If the power is not OFF, the control section 206 is configured to obtain a negative result for step S310 and return to step S220 to repeat the processing.

Accordingly, with the vehicle-installed display device 200 of the second embodiment, the head motion detecting section 202 is configured to detect the motion of the passenger's head or head portion (particularly the eyes) directly. Therefore, the position of the passenger's eyes can be obtained accurately irregardless of the passenger's physique and posture or whether the passenger is an adult or a child.

Moreover, in the second embodiment of the present invention, the screen vibration detecting section 203 is configured to detect the motion of the image display section 208 directly. Thus, the position of the image display section 208 can be obtained accurately in situations where the motion of the image display section 208 is different from the motion of the vehicle, such as when the image display section 208 is installed on a backrest and its position fluctuates due to the vibrations of the backrest.

Then, the vehicle-installed display device 200 of the second embodiment is configured to shift the image including text displayed on the image display section 208 in consideration of the relative displacement between the eyes of the passenger and the image display section 208 using the eye position detected based on the detection result of the head motion detecting section 202 and the position of the image display section 208 detected based on the detection result of the screen vibration detecting section 203. Thus, the displayed image appears stationary in space to the passenger. As a result, similarly to the first embodiment, the image is easier for the passenger to view and the uncomfortable or incongruous feeling of the passenger can be reduced.

Third Embodiment

Figure 9:
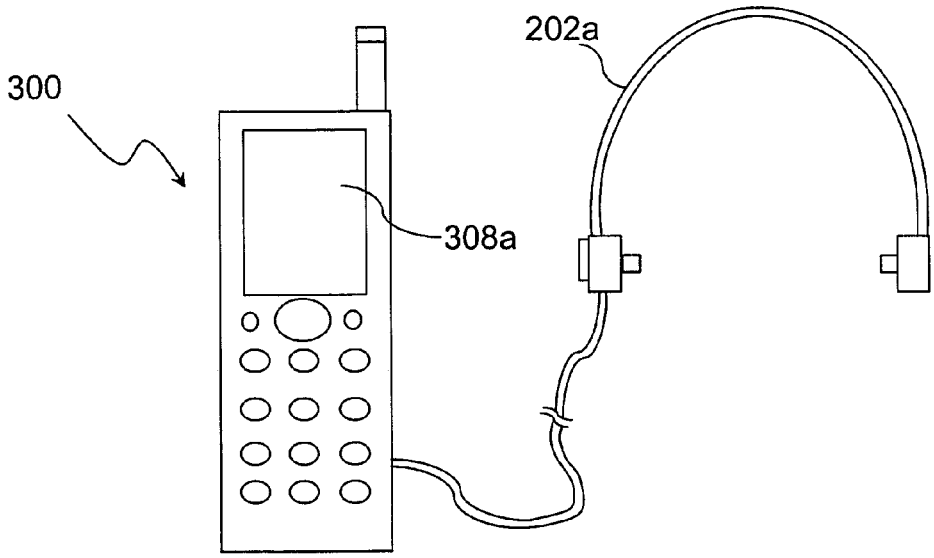
FIG. 9 is a schematic view illustrating a portable display device in accordance with a third embodiment of the present invention.
Figure 10:
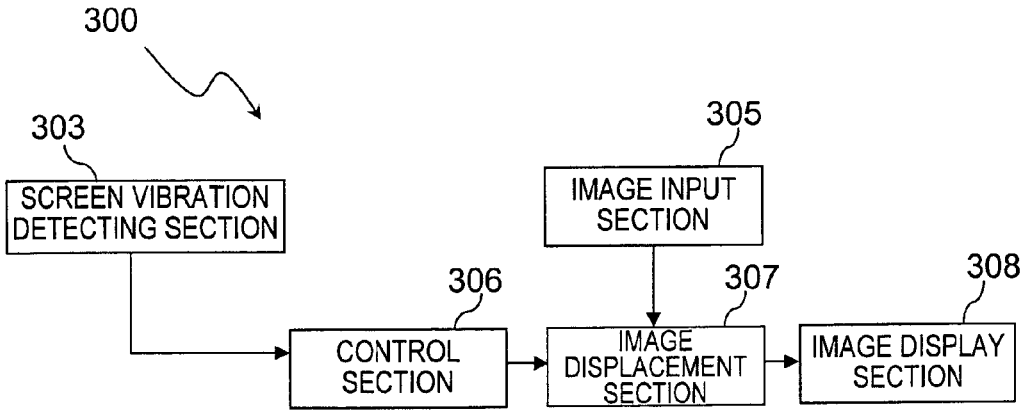
FIG. 10 is a block diagram of the portable display device in accordance with a third embodiment of the present invention.

Referring now to FIGS. 9 and 10, a display device 300 in accordance with a third embodiment will now be explained. In view of the similarity between the first, second and third embodiments, the descriptions of the parts of the third embodiment that are identical to the parts of the first or second embodiments may be omitted for the sake of brevity.

FIG. 10 is a block diagram illustrating the display device 300 in accordance with the third embodiment of the present invention. In the third embodiment, the display device 300 is configured and arranged to be a portable display device that is preferably utilized for a portable game, a portable information terminal (PDA), a portable telephone, or the like. The portable display device 300 in accordance with this embodiment of the present invention detects movements of the display device 300, computes the translational displacement of the displayed image based on the detected information, and displays the image in such a manner as to cancel the displacement as explained below.

As seen in FIG. 10, the portable display device 300 basically comprises a screen vibration detecting section 303, an image input section 305, a control section 306, an image displacement section 307, and an image display section 308 with a display screen 308*a*. The viewer holds the portable display device 300 and views an image displayed on the display screen 308*a*.

The screen vibration detecting section 303 is configured to detect movement of the display screen 308*a* at frequencies of several hertz resulting from shaking of the viewer's arm while the viewer holds the portable display device 300 with the hand. The control section 306 is configured to use the detection signal indicative of the movement of the display screen 308*a* detected by the screen vibration detecting section 303 to calculate the amount of displacement of the display screen 308*a*. The control section 306 is further configured to send information indicating the calculated amount of the displacement of the display screen 308*a* to the image displacement section 307 and issue a command signal instructing to shift the image. The image displacement section 307 is configured to shift the image displayed on the display screen 308*a* in such a manner as to cancel the displacement of the display screen 308*a* indicated by the command signal.

Accordingly, the image displayed on the display screen 308*a*, such as the game image, electronic book, or text information, becomes easier for the viewer to view because the image displayed on the image display section 308 is shifted based on the movement of the viewer's arm that holds the display screen 308*a* causing the displacement of the display screen 308*a*.

Moreover, the portable display device 300 can be made more compact than the display device 200 of the second embodiment because the vehicle motion detecting section 201 and the head motion detection section 202 are eliminated.

Furthermore, the portable display device 300 can also be optionally provided with the head motion detecting section 202 of the second embodiment. In such a case, since the motion of the viewer's head (particularly the eyes) can be detected with the head motion detecting section 202 using the headphones 202*a*, the display position of the image (including text) displayed on the image display section 308 can be shifted in consideration of the relative displacement between the viewer's head and the image display section 308 by using the detected positions of the viewer's head and the image display section 308. As a result, the viewability of the displayed content can improved even further.

Fourth Embodiment

Figure 11:
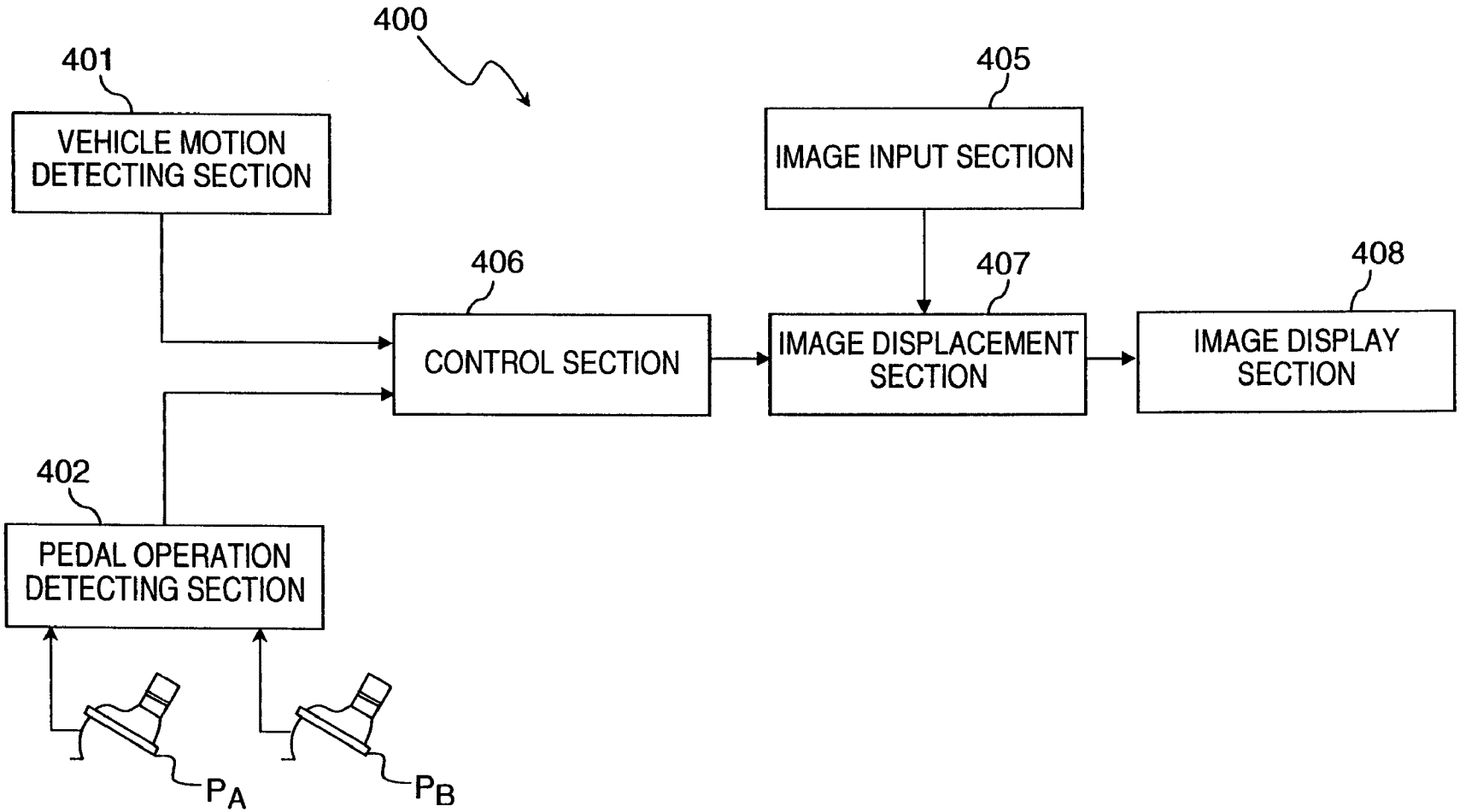
FIG. 11 is a block diagram illustrating a display device adapted to be installed in a vehicle in accordance with a fourth embodiment of the present invention.
Figure 12:
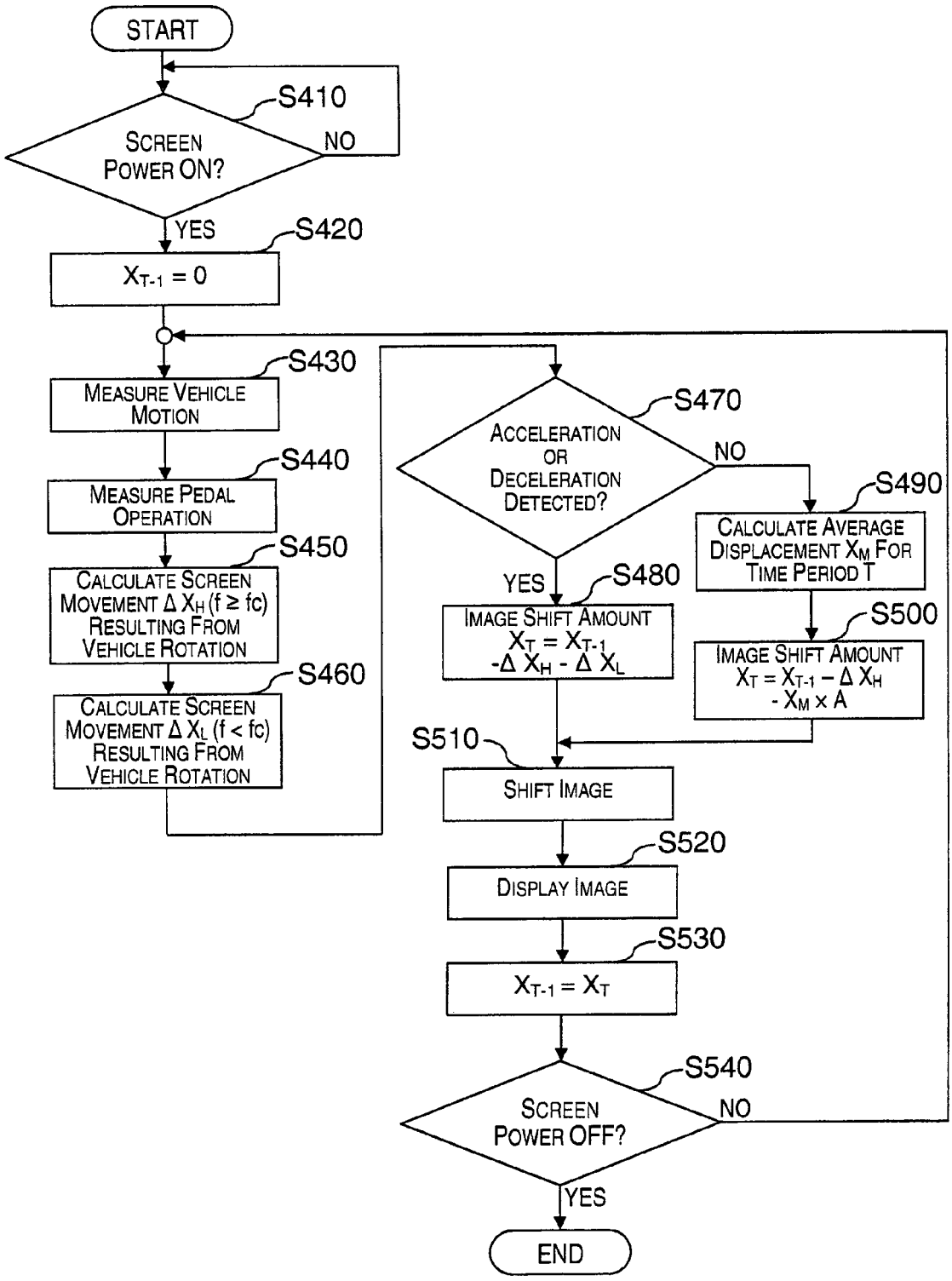
FIG. 12 is a flowchart illustrating a flow of the display processing executed by a control section of the display device in accordance with the fourth embodiment of the present invention.
Figures 13, 14:
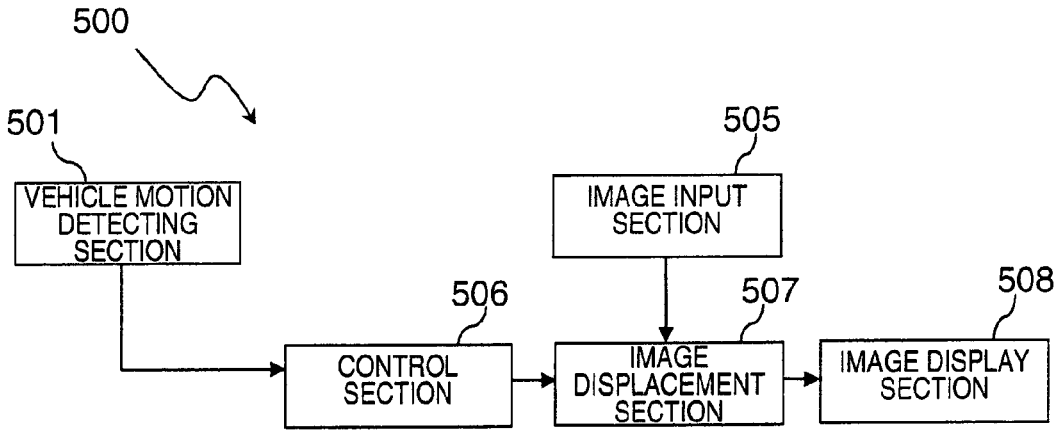
FIG. 13 is a chart showing parameters used in calculating a shifting amount of the image in the display device in accordance with the fourth embodiment of the present invention.
FIG. 14 is a block diagram illustrating a display device adapted to be installed in a vehicle in accordance with a fifth embodiment of the present invention.

Referring now to FIGS. 11–13, a vehicle-installed display device 400 in accordance with a fourth embodiment will now be explained. In view of the similarity between the first and fourth embodiments, the descriptions of the parts of the fourth embodiment that are identical to the parts of the first embodiment may be omitted for the sake of brevity.

In the fourth embodiment of the present invention, the display device 400 is preferably adapted to be installed in the vehicle V of FIGS. 1 and 2 so that a passenger of the vehicle can view an image displayed by the display device 400. FIG. 11 is a block diagram illustrating the vehicle-installed display device 400 in accordance with the fourth embodiment of the present invention. The vehicle-installed display device 400 in accordance with the fourth embodiment of the present invention displays an image in such a manner as to cancel the translational displacement of the displayed image computed using information obtained by detecting movements of the vehicle, as mentioned above in the prior embodiments, and additionally displays the image in such a manner as to cancel the deviation between the center of the displayed image and the center of the display area of the display device 200.

As seen in FIG. 11, the vehicle-installed display device 400 basically comprises a vehicle motion detecting section 401, a pedal operation detecting section 402, a control section 406, an image input section 405, an image displacement section 407, and an image display section 408 with a display screen such as the display screen 108*a* of the first embodiment. The passenger or a viewer views an image displayed on the image display section 408 inside the vehicle.

The vehicle-installed display device 400 in accordance with the fourth embodiment is configured to shift the image displayed on the display section 408 not only in accordance with the motion of the vehicle but also in accordance with the pedal operations, e.g., acceleration or deceleration, of the vehicle detected by the pedal operation detecting section 402. More specifically, when calculating the movement amount of the image display section 408 in the pitch direction (up and down) resulting from upward or downward rotational motion of the vehicle, the vehicle-installed display device 400 is configured to calculate the following two image shift amounts: a screen movement amount $\Delta X_L$ corresponding to a very low frequency range or region where there is the possibility that the visual information will cause the passenger to experience an uncomfortable or incongruous feeling only when the vehicle is accelerating or decelerating; and a screen movement amount $\Delta X_H$ corresponding to a frequency range or region where there is the possibility that the visual information will cause the passenger to experience the uncomfortable or incongruous feeling both when the vehicle is accelerating or decelerating and when the vehicle is traveling at a constant speed. Then, when a pedal operation was detected (when the vehicle is accelerating or decelerating), the display position of the image displayed on the image display section 408 is shifted in the pitch direction in such a manner as to cancel the movement of the display image resulting from the screen movement amount $\Delta X_L$ as well as the screen movement amount $\Delta X_H$. As a result, the display image appears stationary in space to the passenger. Thus, the image is easier for the passenger to view when a forward or rearward G-force (acceleration or deceleration) occurs and since the visual information the passenger obtains when watching the display screen matches the information from the vestibular organs (semicircular canals and otolith organs), the uncomfortable or incongruous feeling can be reduced in comparison with a case in which the image is not shifted.

Moreover, when there is no forward or rearward G-force (acceleration or deceleration) but the vehicle is in a steady slanted state due to a slanted road surface or the like, the screen movement amount $\Delta X_L$ is ignored because there is no pedal operation. Thus, the screen movement amount $\Delta X_H$ can be canceled without compensating for screen movement amount resulting from the slant of the vehicle. Moreover, when a pedal operation is not detected, the vehicle-installed display device 400 is configured to shift the image such that the average display position moves closer to the center of the display region of the image display section 408. By moving the average display position toward the center of the screen, the image can be displayed in a position that is easy to view when the vehicle enters an upward or downward slope from a flat road and more leeway can be secured for compensating for upward and downward movement of the image display section 408 resulting from acceleration or deceleration when traveling on a slope.

The vehicle motion detecting section 401 is configured to detect both the translational motion of the vehicle and the rotational motion of the vehicle and send a detection signal to the control section 406. The pedal operation detecting section 402 is configured to detect operation of an accelerator pedal $P_A$ and a brake pedal $P_B$ by a driver of the vehicle and send a detection signal to the control section 406.

The image input section 405 is configured to receive display data from an external device (e.g., video tape player, DVD player, etc.) and send the display data to the image displacement section 407. The control section 406 is configured to determine the amount of displacement of the image using the detection signal indicating the vehicle motion received from the vehicle motion detecting section 401 and the detection signal indicating the pedal operations received from the pedal operation detecting section 402. In addition to determining the image displacement amount, the control section 406 is configured to control the other sections of the vehicle-installed display device 400. The control section 406 is configured to send information indicating the image displacement amount determined by the control section 406 to the image displacement section 407. Based on the information indicating the amount of image displacement, the image displacement section 407 is configured to modify the display data in such a manner that the display position of the image is shifted within a display region of the image display section 408. The image shifting is executed in a same manner as in the first embodiment.

After the display data is modified by the image displacement section 407, the image displacement section 407 is configured to send the modified display data to the image display section 408 as a display signal. The image display section 408 is, for example, a liquid crystal display device and configured and arranged to display an image in accordance with the inputted display signal. Thus, the image display section 408 is configured to display the image in accordance with the modified display data received from the image displacement section 407. Accordingly, the image displayed on the image display section 408 appears stationary to the passenger because the image is shifted based on the motion of the vehicle and the pedal operations of the vehicle.

Referring now to FIG. 12, the flow of the display processing executed by the control section 406 of the vehicle-installed display device 400 will now be described. In step S410, the control section 406 is configured to determine if the power to the image display section 408 is ON. If the power is ON, the control section 406 is configured to obtain an affirmative result for step S410 and proceed to step S420. If the power is not ON, the control section is configured to obtain a negative result for step S410 and repeat step S410.

In step S420, the control section 406 is configured to reset the image displacement (shift) amount $X_{T-1}$ to the initial value of 0 and then proceed to step S430. The image displacement amount $X_{T-1}$ is defined as a displacement amount of the image displayed on the image display section 408 immediately before the image is shifted. Thus, the image displacement amount $X_{T-1}$ indicates the image display position within the display region of the image display section 408 immediately before the image is shifted. The initial value of 0 is the image shift amount corresponding to displaying the image in the center of the display region of the image display section 408. In other words, when the image shift amount is 0, the center of the displayed image and the center of the display region of the image display section 408 are aligned with each other. In step S430, the control section 406 is configured to issue a command to the vehicle motion detection section 401 instructing to detect the motion of the vehicle (motion measurement) and then proceed to step S440. In response to the command issued in step S430, the vehicle motion detection section 401 is configured to detect both the translational motion and the rotational motion of the vehicle. In step S440, the control section 406 is configured to issue a command to the pedal operation detecting section 402 instructing to detect operation of the pedals (pedal operation measurement) and then proceed to step S450. In response to the command issued in step S440, the pedal operation detecting section 402 is configured to detect operations of the accelerator pedal $P_A$ and the brake pedal $P_B$.

In step S450, the control section 406 is configured to use the detection signal indicating the vehicle motion detected by the vehicle motion detecting section 401 to calculate the screen movement amount $\Delta X_H$. The screen movement amount $\Delta X_H$ is a screen movement amount for which a movement frequency f at which the image display section 408 moves translationally due to the rotational motion of the vehicle exceeding a prescribed frequency fc. The screen movement amount includes movement in both the pitch (up and down) and the roll (left and right) directions of the image display section 408. The movement of the image display section 408 that occurs during constant-speed travel is divided into movements in a very low frequency range where f<fc and movement in a frequency range f≧fc. In general, in the movements in the very low frequency range (f<fc), e.g., frequencies of 0.2 to 0.3 Hz, the passenger does not experience an uncomfortable or incongruous feeling about the visual information even when watching the display screen intently when the vehicle is traveling at a constant speed. However, the movements in this very low frequency range (f<fc) usually cause the uncomfortable or incongruous feeling to the passenger about the visual information when the vehicle accelerates or decelerates. On the other hand, in the movements in the frequency range (f≧fc), e.g., frequencies that are in the vicinity of the resonance frequency of the vehicle (1 to 2 Hz), there is the possibility that the passenger will experience the uncomfortable or incongruous feeling about the visual information even when the vehicle is traveling at a constant speed. As explained above, in step S450, the screen movement amount $\Delta X_H$ is obtained for the frequency region (f≧fc) where there is the possibility that the passenger will experience an uncomfortable or incongruous feeling about the visual information when traveling at a constant speed. Then, the control section 406 is configured to proceed to step S460.

In step S460, the control section 406 is configured to use the detection signal indicating the vehicle motion detected by the vehicle motion detecting section 401 to calculate the screen movement amount $\Delta X_L$ for the very low frequency region (f<fc) and then proceed to step S470. The screen movement amount includes movement in both the pitch (up and down) and the roll (left and right) directions of the image display section 408.

In step S470, the control section 406 is configured to determine if an acceleration or deceleration operation is being executed. More specifically, if the control section 406 receives a detection signal from the pedal operation detecting section 402 indicating there is an acceleration or deceleration operation, the control section 406 is configured to obtain an affirmative result for step S470 and proceed to step S480. If the control section 406 does not receives the detection signal from the pedal operation detecting section 402, the control section 406 is configured to obtain a negative result for step S470 and proceed to step S490.

Accordingly, step S480 is executed in cases where an acceleration or deceleration operation is being executed. When acceleration or deceleration of the vehicle occurs, the vehicle undergoes motion in the pitch direction or roll direction in response to inertial forces, and thus, the image display section 408 installed in the vehicle moves. This vehicle motion includes very low frequency movements, e.g., movements at frequencies from 0.2 to 0.3 Hz. Thus, when it is determined that an acceleration or deceleration operation is taking place, the image shift amount is calculated based on the screen movement amount $\Delta X_L$ for the very low frequency region (f<fc), which includes the very low frequencies, and the screen movement amount $\Delta X_H$ for the frequency region f≧fc.

In step S480, the control section 406 is configured to use Equation (1) shown below to calculate the translational image shift amount $X_T$ resulting from the rotational motion of the vehicle and the acceleration or deceleration operation.

$$X_T = X_{T-1} - \Delta X_H - \Delta X_L \quad (1)$$

As explained above, $X_{T-1}$ is the image shift amount immediately before the image is shifted. The reason the screen movement amount $\Delta X_H$ and the screen movement amount $\Delta X_L$ are subtracted from the image shift amount $X_{T-1}$ is to shift the image in the opposite direction as the direction of the movement of the image display section 408. Then, the control section 406 is configured to proceed to step S510.

In step S510, the control section 406 is configured to send information indicating the calculated image shift amount $X_T$ to the image displacement section 407 and issues a command instructing to shift the image. In response to the command issued in step S510, the image displacement section 407 is configured to modify the display data received from the image input section 405 in accordance with the shift amount $X_T$. Then, the control section is configured to proceed to step S520.

In step S520, the control section 406 is configured to issue a command to the image display section 408 instructing to display the image based on the modified display data and then proceed to step S530. In response to the command issued in step S520, the image display section 408 is configured to display an image that has been shifted within the display region of the image display section 408. In step S530, the control section 406 is configured to update the $X_{T-1}$ by substituting the current shift amount $X_T$ as the value for $X_{T-1}$ (i.e., replacing $X_{T-1}$ with the current shift amount $X_T$) and then proceed to step S540. In step S540, the control section 406 is configured to determine if the power to the image display section 408 is OFF. If the power is OFF, the control section 406 is configured to obtain an affirmative result for step S540 and end the processing of the flow chart shown in FIG. 12. If the power is not OFF, the control section 406 is configured to obtain a negative result for step S540 and return to step S430 to repeat the processing.

Step S490 is executed in cases where an acceleration or deceleration operation is not being detected. In such cases, the screen movement amount $\Delta X_L$ corresponding to the very low frequency region (f<fc) does not cause the passenger to experience uncomfortable or incongruous feeling, and thus, the movements in the very low frequency region are ignored. Also, in such cases, the vehicle-installed display device 400 is configured to shift the image such that the average display position moves closer to the center of the display region of the image display section 408. Thus, in step S490, the control section 406 is configured to calculate the average screen movement amount $X_M$ corresponding to a prescribed period of time T immediately preceding the point in time when the calculation is made. Then, the control section 406 is configured to proceed to step S500.

In step S500, the control section 406 is configured to calculate the translational image shift amount $X_T$ resulting from rotational motion of the vehicle using Equation (2) below.

$$X_T = X_{T-1} - \Delta X_H - X_M \times A \quad (2)$$

As explained above, $X_{T-1}$ is the image shift amount immediately before the image is shifted. In this Equation (2), the term A is a prescribed coefficient. The reason the screen movement amount $\Delta X_H$ and the product of the average screen movement amount $\Delta X_M$ and the coefficient A are subtracted from the image shift amount $X_{T-1}$ is to shift the image in the opposite direction as the direction of the movement of the image display section 408. Then, the control section 406 is configured to proceed to step S510 explained above.

The average screen movement amount $X_M$ indicates the average display position of the image displayed in the display region of the image display section 408. In Equation 2, the image shift amount $X_T$ is brought closer to the initial value of 0 calculated in step S420 by subtracting the average screen movement amount $X_M$ from the image shift amount $X_{T-1}$. In other words, the image shift amount is calculated in such a manner as to bring a prescribed display position (e.g., the center) of the displayed image closer to a prescribed screen position (e.g., the center) of the display region of the image display section 408.

The processing of step S490 is preferably executed no faster than once every three seconds because when neither an acceleration operation nor a deceleration operation is being executed, it is not necessary to use information related to the very low frequency region (f<fc), e.g., frequencies of 0.2 to 0.3 Hz. Also, it is preferred that the prescribed coefficient A be a small value in order to move the display position of the image toward the center of the screen gradually when the average screen movement amount is $X_M$ is large.

FIG. 13 is a table showing the parameters used for calculating the image shift amount in the vehicle-installed display device 400. In FIG. 13, a circle (○) indicates that the parameter is used in the calculation and an X (×) indicates that the parameter is not used in the calculation. When traveling at a constant speed (steady-state travel), the calculation is accomplished using the display position (i.e., image shift amount) $X_{T-1}$ immediately before shifting the image, the screen displacement change amount (i.e., screen movement amount) $\Delta X_H$ for the frequency region f≧fc, and the average displacement (i.e., screen movement amount) $X_M$ during the time period T. When acceleration or deceleration is occurring, the calculation is accomplished using the display position (i.e., image shift amount) $X_{T-1}$ immediately before shifting the image, the screen position change amount (i.e., screen movement amount) $\Delta X_H$ for the frequency region f≧fc, and the screen position change amount (i.e., screen movement amount) $\Delta X_L$ for the frequency region f<fc.

Accordingly, in the vehicle-installed display device 400 in accordance with the fourth embodiment, when calculating the movement amount of the image display section 408 in the pitch direction (up and down) resulting from rotational motion of the vehicle, the following two image shift amounts $\Delta X_L$ and $\Delta X_H$ are calculated. The screen movement amount $\Delta X_L$ corresponds to the very low frequency range (f<fc) where there is the possibility that the visual information will cause the passenger to experience an uncomfortable or incongruous feeling when the vehicle is accelerating or decelerating. The screen movement amount $\Delta X_H$ corresponds to a frequency region f≧fc where there is the possibility that the visual information will cause the passenger to experience the uncomfortable or incongruous feeling both when the vehicle is accelerating or decelerating and when the vehicle is traveling at a constant speed. When a pedal operation was detected (affirmative result for step S470), the display position of the image displayed on the image display section 408 is shifted in the pitch direction in such a manner as to cancel the movement of the display image resulting from both of the screen movement amount $\Delta X_L$ and the screen movement amount $\Delta X_H$. As a result, the display image appears stationary in space to the passenger. Thus, the image is easier for the passenger to view when a longitudinal G-force (acceleration) occurs and since the visual information the passenger obtains when watching the display screen matches the information from the vestibular organs (semicircular canals and otolith organs), the uncomfortable or incongruous feeling can be reduced in comparison with a case in which the image is not shifted.

When a pedal operation is not detected (negative result for step S470), the screen movement amount $\Delta X_H$ and the product of the average screen movement amount $\Delta X_M$ the coefficient A are used to cancel the movement of the display image resulting from the screen movement amount $\Delta X_H$. As a result, when there is no forward or rearward G-force (acceleration), movement of the display screen resulting from the screen movement amount $\Delta X_H$ in the vicinity of the resonance frequency of the vehicle (e.g., 1 to 2 Hz) can be canceled without compensating for screen movement amount resulting from stead-state leaning of the vehicle due to a slanted road surface or the like. Moreover, the vehicle-installed display device 400 is configured to shift the image such that the average display position moves closer to the center of the screen of the image display section 408. Thus, by moving the average display position toward the center of the screen, the image can be displayed in a position that is easy to view when the vehicle enters an upward or downward slope from a flat road and more leeway can be secured for compensating for upward and downward movement of the image display section 408 resulting from acceleration or deceleration when traveling on a slope.

Although the fourth embodiment was described using rotational motion of the vehicle in the pitch direction during acceleration or deceleration as an example, the similar processing can be executed with respect to rotational motion of the vehicle in the rolling direction (left and right) during cornering. In such a case, for example, it can be determined if a cornering operation is being performed by detecting at least one of the following: steering operation, lateral acceleration, and yaw acceleration.

Fifth Embodiment

Figure 15:
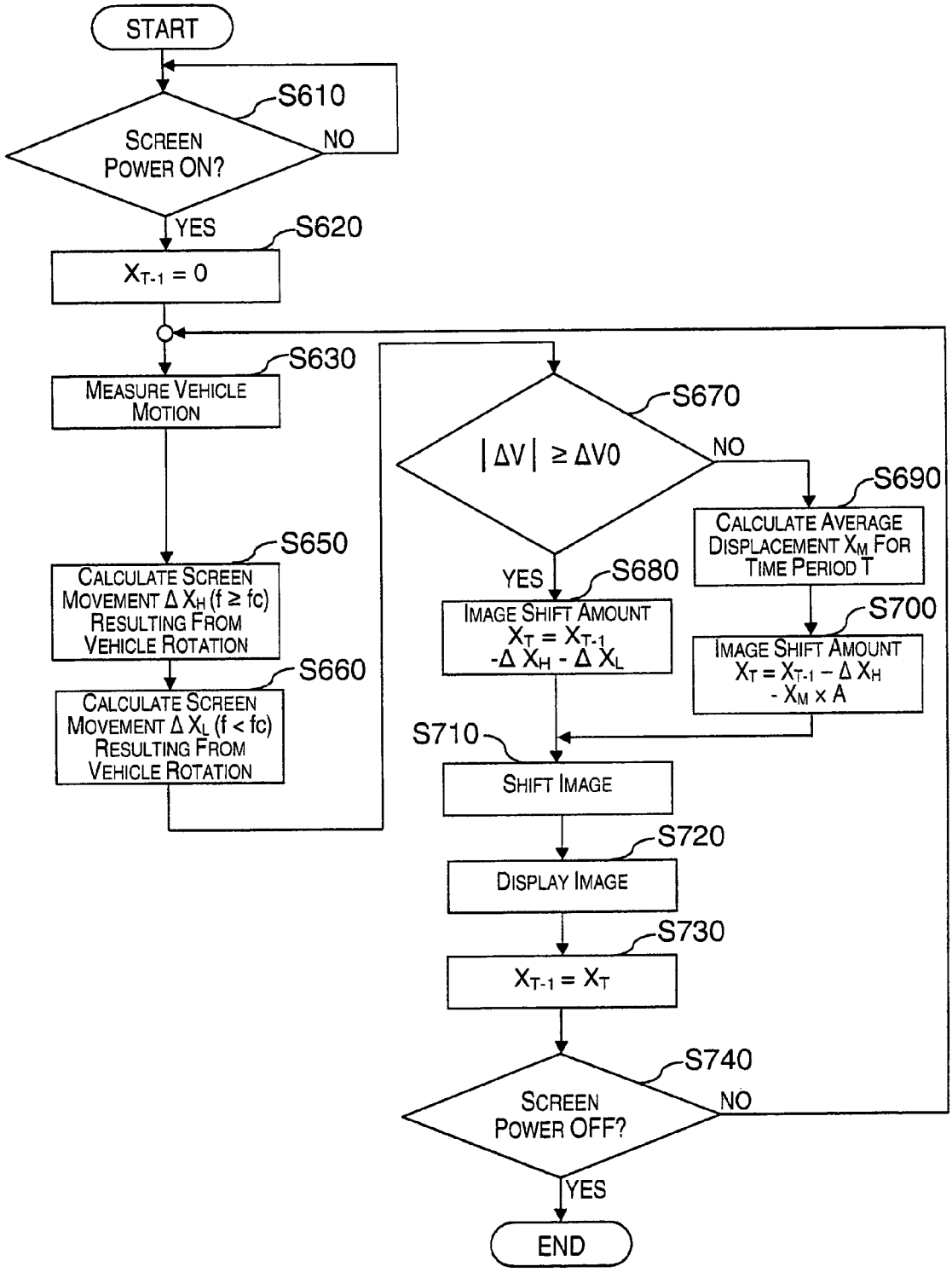
FIG. 15 is a flowchart illustrating a flow of the display processing executed by a control section of the display device in accordance with the fifth embodiment of the present invention.

Referring now to FIGS. 14 and 15, a display device 500 in accordance with a fifth embodiment will now be explained. In view of the similarity between the fourth and fifth embodiments, the descriptions of the parts of the fifth embodiment that are identical to the parts of the fourth embodiment may be omitted for the sake of brevity.

The display device 500 of the fifth embodiment is adapted to be installed in the vehicle V of FIGS. 1 and 2 so that a passenger of the vehicle can view an image displayed by the display device 500 inside the vehicle. FIG. 14 is a block diagram illustrating a vehicle-installed display device 500 in accordance with the fifth embodiment of the present invention. As seen in FIG. 14, the vehicle-installed display device 500 basically comprises a vehicle motion detecting section 501, a control section 506, an image input section 505, an image displacement section 507, and an image display section 508 with a display screen such as the display screen 108*a* of the first embodiment. The viewer views an image displayed on the image display section 508 inside the vehicle.

The vehicle-installed display device 500 of the fifth embodiment is configured to shift the displayed image not only in accordance with the motion of the vehicle but also in accordance with whether or not deceleration or acceleration is determined to be taking place. Moreover, in the fifth embodiment, whether or not deceleration or acceleration is taking place is determined based on a change in vehicle speed ΔV that is detected in the vehicle motion detecting section 501.

The vehicle motion detecting section 501 is configured to detect the translational motion and the rotational motion of the vehicle and send a detection signal to the control section 506. Moreover, the vehicle motion detection section 501 is also configured to measure the change in vehicle speed ΔV. The change in vehicle speed ΔV is the difference between the vehicle speed detected in the previous control cycle and the newly detected vehicle speed. The image input section 505 is configured to receive image data from an external device (e.g., video tape player, DVD player, etc.) and send the image data to the image displacement section 507. The control section 506 is configured to determine the amount of displacement of the image using the detection signal indicating the vehicle motion based. In addition to determining the amount of image displacement, the control section 506 is configured to control the other sections of the vehicle-installed display device 500. The control section 506 is configured to send information indicating the amount of image displacement determined by the control section 506 to the image displacement section 507. Based on the information indicating the amount of image displacement, the image displacement section 507 is configured to modify the display data in such a manner that the position of the image including text is shifted within a display region of the image display section 508. The image shifting is executed in the same manner as in the first embodiment.

After the display data is modified by the image displacement section 507, the image display section 507 is configured to send the modified display data to the image display section 508 as a display signal. The image display section 508 is, for example, a liquid crystal display device and configured and arranged to display an image in accordance with the inputted display signal. Thus, the image display section 508 is configured to display the image based on the modified display data received from the image displacement section 507.

Referring now to FIG. 15, the flow of the display processing executed by the control section 506 of the vehicle-installed display device 500 will now be described. In step S610, the control section 506 is configured to determine if the power to the image display section 508 is ON. If the power is ON, the control section 506 is configured to obtain an affirmative result for step S610 and proceed to step S620. If the power is not ON, the control section 506 is configured to obtain a negative result for step S610 and repeat step S610.

In step S620, the control section 506 is configured to reset the image displacement (shift) amount $X_{T-1}$ to the initial value of 0, then proceed to step S630. The image displacement amount $X_{T-1}$ is the displacement amount of the image displayed on the image display section 508 immediately before the image is shifted. Thus, the image displacement amount $X_{T-1}$ indicates the image display position within the display region of the image display section 508 before the image is shifted. In step S630, the control section 506 is configured to issue a command to the vehicle motion detection section 501 instructing to detect the motion of the vehicle (motion measurement) and then proceed to step S650. In response to the command issued in step S630, the vehicle motion detection section 501 is configured to detect the translational motion, the rotational motion, and the change in speed ΔV of the vehicle.

In step S650, the control section 506 is configured to use the detection signal indicating the vehicle motion to calculate the screen movement amount $\Delta X_H$ for which the movement frequency f at which the image display section 508 moves translationally due to the upward or downward rotational motion of the vehicle exceeds a prescribed frequency fc. The screen movement amount includes movement in both the pitch (up and down) and the roll (left and right) directions of the image display section 508. The prescribed frequency f is preferably the same as the frequency described in the fourth embodiment. Then the control section 506 is configured to proceed to step S660.

In step S660, the control section 506 is configured to use the detection signal indicating the vehicle motion to calculate the screen movement amount $\Delta X_L$ for the very low frequency region (f<fc) and then proceed to step S670. The screen movement amount includes movement in both the pitch (up and down) and the roll (left and right) directions of the image display section 508.

In step S670, the control section 506 is configured to determine if the vehicle is being accelerated or decelerated by comparing the change in vehicle speed ΔV with a threshold value. If the absolute value of the change in vehicle speed |ΔV| is found to satisfy the relationship $|\Delta V| \geqq \Delta V0$, where ΔV0 is a predetermined threshold value, the control section 506 is configured obtain an affirmative result for step S670 and proceed to step S680. If the relationship $|\Delta V| \geqq \Delta V0$ is not satisfied, the control section 506 is configured to obtain a negative result for step S670 and proceed to step S690.

Accordingly, step S680 is executed in cases where an acceleration or deceleration operation is determined to be in progress. In step S680, the control section 506 is configured to use the Equation 1 explained in the fourth embodiment to calculate the translational image shift amount $X_T$ resulting from the rotational motion of the vehicle and the acceleration or deceleration operation of the vehicle. Then, the control section 506 is configured to proceed to step S710.

On the other hand, step S690 is executed in cases where an acceleration or deceleration operation is not considered to be in progress. In such cases, the screen movement amount $\Delta X_L$ corresponding to the very low frequency region (f<fc) does not cause the passenger to experience uncomfortable or incongruous feeling, and thus, the movements in the very low frequency region are ignored. Also, in such cases, the vehicle-installed display device 500 is configured to shift the image such that the average display position moves closer to the center of the display region of the image display section 508. Thus, in step S690, the control section 506 is configured to calculate the average screen movement amount $X_M$ corresponding to a prescribed period of time T immediately preceding the point in time when the calculation is made. Then, the control section 506 is configured to proceed to step S700.

In step S700, the control section 506 is configured to calculate the translational image shift amount $X_T$ resulting from rotational motion of the vehicle using the Equation 2 explained in the fourth embodiment and then proceed to step S710.

In step S710, the control section 506 is configured to send information indicating the calculated image shift amount $X_T$ to the image displacement section 507 and issue a command instructing to shift the image. In response to the command issued in the step S710, the image displacement section 507 is configured to modify the display data received from the image input section 505 in accordance with the shift amount $X_T$. Then, the control section 506 is configured to proceed to step S720.

In step S720, the control section 506 is configured to issue a command to the image display section 508 instructing to display the image based on the modified display data and then proceed to step S730. In response to the command issued in step S720, the image display section 508 is configured to display an image that has been shifted within the display region of the image display section 508. In step S730, the control section 506 is configured to update $X_{T-1}$ by substituting the current shift amount $X_T$ as the value for $X_{T-1}$ (i.e., replacing $X_{T-1}$ with the current shift amount $X_T$) and then proceed to step S740. In step S740, the control section 506 is configured to determine if the power to the image display section 508 is OFF. If the power is OFF, the control section 506 is configured to obtain an affirmative result for step S740 and end the processing of the flow chart shown in FIG. 15. If the power is not OFF, the control section 506 is configured to obtain a negative result for step S740 and return to step S630 to repeat the processing.

Accordingly, in the vehicle-installed display device 500 of the fifth embodiment, when it is determined that an acceleration or deceleration operation of the vehicle is in progress (affirmative result for step S670), the display position of the image displayed on the image display section 508 is shifted in the pitch direction in order to cancel the movement of the displayed image resulting from both the screen movement amount $\Delta X_L$ and the screen movement amount $\Delta X_H$. As a result, similarly to the fourth embodiment, the image is easier for the passenger to view when a longitudinal G-force (acceleration) occurs and an uncomfortable or incongruous feeling experienced when watching the display screen intently can be reduced.

Moreover, when it is determined that an acceleration or deceleration operation of the vehicle is not in progress (negative result for step S670), the screen movement amount $\Delta X_H$ and the product of the average screen movement amount $\Delta X_M$ and the coefficient A are used to cancel the movement of the displayed image resulting from the screen movement amount $\Delta X_H$. Thus, the vehicle-installed display device 500 is configured to shift the image such that the average display position moves closer to the center of the screen of the image display section 508. As a result, similarly to the fourth embodiment, when there is no forward or rearward G-force (acceleration), movement of the display screen resulting from the screen movement amount $\Delta X_H$ in the vicinity of the resonance frequency of the vehicle (e.g., 1 to 2 Hz) can be canceled without compensating for the movement of the displayed image resulting a slanted road surface or the like. Also, by moving the average display position toward the center of the screen, the image can be displayed in a position that is easy to view when the vehicle enters an upward or downward slope from a flat road and more leeway can be secured for compensating for upward and downward movement of the image display section 508 resulting from acceleration or deceleration when traveling on a slope.

Furthermore, since the amount of the change in the vehicle speed AV detected in the vehicle motion detecting section 501 is used to determine if an acceleration or deceleration operation is being executed, the pedal operation detecting section 402 of the fourth embodiment can be eliminated.

In the above description of the embodiments, the vehicle motion detection section 101, 201, 401 or 501, the screen vibration detecting section 203 or the screen vibration detecting section 303 constitutes a motion detecting section. The image display section 108, 208, 308, 408 or 508 constitutes a display section. The translational displacement corresponds, for example, to the image movement amount. The control section 106, 206, 306, 406 or 506 constitute an image displacement computing section and a relative displacement computing section. The image displacement section 107, 207, 307, 407 or 507 constitutes a display control section. The passenger motion estimating section 104 or the head motion detecting section 202 constitutes a viewer motion determining section. The control section 406 or 506 constitutes a center deviation computing section and acceleration/deceleration operation determining section. Moreover, so long as the characteristic functions of the invention are not lost, the constituent elements of the present invention are not limited to those described heretofore.

This application claims priority to Japanese Patent Application Nos. 2002-340711 and 2003-44052. The entire disclosure of Japanese Patent Application Nos. 2002-340711 and 2003-44052 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A road vehicle display device comprising:

a display section configured and arranged to be fixedly coupled to a road vehicle to display an image within a display region of a non-head mounted display screen to a viewer inside the road vehicle;

a motion detecting section configured and arranged to compute a movement of the display section by determining movement of the road vehicle in which the road vehicle display device is used;

an image displacement computing section configured to compute a translational displacement of the display section based on the movement of the display section;

a viewer motion determining section configured and arranged to determine a viewer motion value that is indicative of a movement of a head portion of a viewer watching the display section;

a relative displacement computing section configured to compute a relative displacement between the display section and the head portion of the viewer based on the translational displacement of the display section computed by the image displacement computing section and the viewer motion value of the head portion of the viewer determined by the viewer motion determining section; and a display control section configured to shift a display position of the image within the display region of the display screen by an amount based on the relative displacement to stabilize the image within the display section to the viewer.

2. The road vehicle display device as recited in claim 1, further comprising a head motion detecting section configured and arranged to detect the movement of the head portion of the viewer, the viewer motion determining section being further configured and arranged to determine the viewer motion value based on a detection result from the head motion detecting section.

3. The road vehicle display device as recited in claim 1, wherein the viewer determining section is further configured and arranged to determine the viewer motion value based on at least one of a response function of vibration of a human body corresponding to the viewer in response to the movement of the vehicle and a numerical model indicative of the vibration of the human body in response to the movement of the vehicle.

4. The road vehicle display device as recited in claim 3, wherein the viewer motion determining section is further configured and arranged to determine the viewer motion value using at least one of weight of the viewer, height of the viewer, mass of the viewer, shape of the viewer and a sitting posture of the viewer as an estimate parameter.

5. The road vehicle display device as recited in claim 3, wherein the viewer motion determining section is further configured and arranged to select the response function of the vibration of the human body corresponding to at least one of weight of the viewer, height of the viewer, mass of the viewer, shape of the viewer and a sitting posture of the viewer estimated based on a distribution of a body pressure on a seat on which the viewer is sitting.

6. A display device comprising:

a display section configured and arranged to display an image within a display region of a non-head mounted display screen, the display section being configured and arranged to be fixedly coupled to a vehicle to display the image to a passenger inside the vehicle;

a motion detecting section configured and arranged to detect a movement of the display section by detecting a movement of the vehicle;

an image displacement computing section configured to compute a translational displacement of the display section based on the movement of the display section;

a center deviation computing section configured and arranged to compute a center deviation between a center of the image and a center of the display region of the display section based on a translated position of the display section; and a display control section configured to adjust a display position of the image within the display region of the display section based simultaneously on the translational displacement of the display section and the center deviation.

7. The display device as recited in claim 6, wherein the center deviation computing section is further configured and arranged to set the center of the image using an average position of centers of a plurality of images consecutively displayed in the display section within a prescribed period of time and repeat computing the center deviation not faster than once every three seconds.

8. A road vehicle display device comprising:

a display section configured and arranged to display an image within a display region of a non-head mounted display screen, the display section being configured and arranged to be fixedly coupled to a road vehicle to display the image to a viewer inside the road vehicle;

a motion detecting section configured and arranged to detect a movement of the display section by detecting a movement of the road vehicle in which the road vehicle display device is equipped;

an image displacement computing section configured to compute a translational displacement of the display section based on the movement of the display section;

an acceleration/deceleration operation determining section configured and arranged to determine whether the vehicle is accelerating or decelerating;

a center deviation computing section configured and arranged to compute a center deviation between a center of the image and a center of the display region of the display section, the center deviation computing section being further configured and arranged to stop computing the center deviation upon determining that the vehicle is accelerating or decelerating; and a display control section configured to adjust a display position of the image within the display region of the display section based on the translational displacement of the display section and the center deviation, with the display control section being configured to stop using a center deviation that is computed during periods of acceleration and deceleration of the road vehicle.

9. The display device as recited in claim 8, wherein the acceleration/deceleration operation determining section is further configured and arranged to determine whether the vehicle is accelerating or decelerating by detecting at least one of an accelerator pedal operation, a steering operation and a vehicle motion.

10. The display device as recited in claim 7, wherein an acceleration/deceleration operation determining section configured and arranged to determine whether the vehicle is accelerating or decelerating, the center deviation computing section being further configured and arranged to stop computing the center deviation when it is determined that the vehicle is accelerating or decelerating.

11. The display device as recited in claim 10, wherein the acceleration/deceleration operation determining section is further configured and arranged to determine whether the vehicle is accelerating or decelerating by detecting at least one of an accelerator pedal operation, a steering operation and a vehicle motion.

12. A display device comprising:

a display section configured and arranged to display an image within a display region of a non-head mounted display screen the display section being configured and arranged to be fixedly coupled to a vehicle to display the image to a passenger inside the vehicle;

a motion detecting section configured and arranged to detect a movement of the display section by detecting a movement of the vehicle;

an image displacement computing section configured to compute a translational displacement of the display section based on the movement of the display section;

a display control section configured to adjust a display position of the image within the display region of the display section based at least on the translational displacement of the display section; and an acceleration/deceleration operation determining section configured and arranged to determine whether the vehicle is accelerating or decelerating, the image displacement computing section being further configured to compute the translational displacement divided into a low frequency displacement which is not detectable by the passenger when the vehicle travels at a constant speed and a high frequency displacement which is detectable by the passenger when the vehicle travels at a constant speed, the display control section being further configured to adjust the display position of the image within the display region of the display section based on the low frequency displacement and the high frequency displacement when the vehicle is accelerating or decelerating and based on the high frequency displacement when the vehicle is not accelerating or decelerating.

13. The display device as recited in claim 12, further comprising a center deviation computing section configured and arranged to compute a center deviation between a center of the image and a center of a display region of the display section, the display control section being further configured and arranged to shift the image on the display section based on the center deviation.

14. The display device as recited in claim 1, wherein the display section, the motion detecting section, the image displacement computing section and display control section are configured and arranged to be part of a portable, hand held device.

15. A display device comprising:

a display section configured and arranged to display an image within a display region of a non-head mounted display screen;

a motion detecting section configured and arranged to detect a movement of the display section;

an image displacement computing section configured to compute a translational displacement of the display section based on the movement of the display section;

a viewer motion determining section configured and arranged to determine a viewer motion value that is indicative of a movement of a head portion of a viewer watching the display section;

a relative displacement computing section configured to compute a relative displacement between the display section and the head portion of the viewer based on the translational displacement of the display section computed by the image displacement computing section and the viewer motion value of the head portion of the viewer determined by the viewer motion determining section; and a display control section configured to adjust a display position of the image within the display region of the display section based on the relative displacement, the display control section being further configured to shift the image by an amount based on the relative displacement to stabilize the image to the viewer, the display section, the motion detecting section, the image displacement computing section and display control section being configured and arranged to be part of a portable, hand held device.

16. A display device comprising:

means for displaying an image within a display region;

means for detecting a movement of the display means;

means for computing a translational displacement of the display means based on the movement of the display means;

means for determining a viewer motion value that is indicative of a movement of a head portion of a viewer watching the display section;

means for computing a relative displacement between the display section and the head portion of the viewer based on the translational displacement of the display section computed by the image displacement computing means and the viewer motion value of the head portion of the viewer determined by the viewer motion determining means; and means for adjusting a display position of the image within the display region of the display means based on the relative displacement.

17. A method comprising:

displaying an image within a display region of a road vehicle display device disposed within a road vehicle to a viewer inside the road vehicle;

determining a movement of the display device by determining movement of the road vehicle in which the road vehicle display device is used;

computing a translational displacement of the display device based on the movement of the display device;

determining a viewer motion value that is indicative of a movement of a head portion of a viewer watching the display section;

computing a relative displacement between the display section and the head portion of the viewer based on the translational displacement of the display section and the viewer motion value of the head portion of the viewer; and shifting a display position of the image within the display region of the display device by an amount based on the relative displacement to stabilize the image within the display section to the viewer.

* * * * *